US010610724B2

(12) United States Patent
Chuang

(10) Patent No.: US 10,610,724 B2
(45) Date of Patent: Apr. 7, 2020

(54) ROLLER EXERCISING DEVICE AND SET OF ROLLER EXERCISING DEVICES

(71) Applicant: Lung-Fei Chuang, Taichung (TW)

(72) Inventor: Lung-Fei Chuang, Taichung (TW)

( * ) Notice: Subject to any disclaimer, the term of this patent is extended or adjusted under 35 U.S.C. 154(b) by 158 days.

(21) Appl. No.: 15/803,859

(22) Filed: Nov. 6, 2017

(65) Prior Publication Data

US 2019/0030391 A1 Jan. 31, 2019

(30) Foreign Application Priority Data

Jul. 26, 2017 (TW) ..... 106211006 U
Jul. 26, 2017 (TW) ..... 106211007 U

(51) Int. Cl.
*A63B 21/00* (2006.01)
*A63B 5/20* (2006.01)
(Continued)

(52) U.S. Cl.
CPC ..... *A63B 21/4035* (2015.10); *A63B 5/20* (2013.01); *A63B 21/0004* (2013.01);
(Continued)

(58) Field of Classification Search
CPC ..... A61H 15/0092; A61H 2015/0014; A63B 23/02; A63B 5/20; A63B 22/20; A63B 21/4035; A63B 71/0054; A63B 24/0062; A63B 23/1281; A63B 23/12; A63B 23/0205; A63B 21/0442; A63B 21/4049; A63B 21/4034; A63B 21/00043; A63B 23/1236; A63B 21/0557; A63B 21/0552; A63B 2209/00; A63B 2208/0204; A63B 2071/0072; A63B 2220/17;
(Continued)

(56) References Cited

U.S. PATENT DOCUMENTS 4,768,778 A * 9/1988 Thomas, Jr. ..... A63B 22/14 482/141
7,063,646 B1 * 6/2006 Slimi ..... A63B 22/14 482/141
(Continued)

FOREIGN PATENT DOCUMENTS

CN 203494108 U 3/2014
CN 205198832 U 5/2016
(Continued)

*Primary Examiner* — Garrett K Atkinson
(74) *Attorney, Agent, or Firm* — CKC & Partners Co., LLC

(57) ABSTRACT

The present disclosure provides a handle exercising device and a set of exercising devices. The handle exercising device includes a handle body, a chamber, a buckle portion, a release button, and two female buckles. The handle body has a top surface and a bottom surface. The chamber is disposed in the handle body along an axial direction of the handle body, wherein the chamber has an opening facing one end of the handle body. The buckle portion is disposed in the chamber and buckles a predetermined assembly inserting the chamber via the opening. The release button is disposed at the top surface of the handle body and connected with the buckle portion to release a buckling status of the buckling portion. The female buckles are disposed at the bottom surface of the handle body and arranged in parallel along the axial direction.

4 Claims, 35 Drawing Sheets

(51) Int. Cl.

| | |
|---|---|
| ***A63B 21/055*** | (2006.01) |
| ***A63B 22/20*** | (2006.01) |
| ***A63B 23/12*** | (2006.01) |
| ***A63B 23/035*** | (2006.01) |
| ***A63B 23/02*** | (2006.01) |
| ***A63B 21/068*** | (2006.01) |
| ***A63B 23/16*** | (2006.01) |
| ***A63B 21/04*** | (2006.01) |
| ***A63B 24/00*** | (2006.01) |
| ***A63B 71/00*** | (2006.01) |
| ***A63B 21/002*** | (2006.01) |
| ***A63B 71/02*** | (2006.01) |

(52) U.S. Cl.

CPC .... *A63B 21/00043* (2013.01); *A63B 21/0442* (2013.01); *A63B 21/0552* (2013.01); *A63B 21/0557* (2013.01); *A63B 21/068* (2013.01); *A63B 21/4034* (2015.10); *A63B 21/4043* (2015.10); *A63B 21/4049* (2015.10); *A63B 22/20* (2013.01); *A63B 23/02* (2013.01); *A63B 23/0205* (2013.01); *A63B 23/0211* (2013.01); *A63B 23/03525* (2013.01); *A63B 23/12* (2013.01); *A63B 23/1236* (2013.01); *A63B 23/1281* (2013.01); *A63B 23/16* (2013.01); *A63B 24/0062* (2013.01); *A63B 71/0054* (2013.01); *A63B 21/0023* (2013.01); *A63B 23/1209* (2013.01); *A63B 2071/0072* (2013.01); *A63B 2071/027* (2013.01); *A63B 2208/0204* (2013.01); *A63B 2208/0219* (2013.01); *A63B 2208/0295* (2013.01); *A63B 2209/00* (2013.01); *A63B 2210/50* (2013.01); *A63B 2220/17* (2013.01); *A63B 2220/40* (2013.01); *A63B 2220/803* (2013.01)

(58) Field of Classification Search

CPC ..... A63B 2208/0219; A63B 23/16; A63B 23/03525; A63B 23/0211; A63B 21/068; A63B 21/0004; A63B 2220/803; A63B 2220/40; A63B 2210/50; A63B 2208/0295; A63B 2071/027; A63B 23/1209; A63B 21/0023; A63B 21/4043

See application file for complete search history.

(56) References Cited

U.S. PATENT DOCUMENTS

| | | | | |
|---|---|---|---|---|
| 7,175,573 | B1 * | 2/2007 | Huang | A63B 21/0004 446/236 |
| 7,468,025 | B2 * | 12/2008 | Hauser | A63B 21/00047 482/141 |
| 7,553,267 | B1 * | 6/2009 | Hauser | A63B 21/00047 482/141 |
| 7,896,789 | B2 * | 3/2011 | Hinton | A63B 21/00047 482/141 |
| 7,909,746 | B2 * | 3/2011 | Gant | A63B 21/00047 482/141 |
| 7,922,634 | B1 * | 4/2011 | Wu | A63B 21/0004 482/121 |
| 7,935,039 | B2 * | 5/2011 | Dannenberg | A63B 22/14 482/141 |
| D651,669 | S * | 1/2012 | Garland | D21/662 |
| 8,137,251 | B2 * | 3/2012 | Tozzi | A63B 22/203 482/132 |
| 8,784,287 | B2 * | 7/2014 | Miller, Jr. | A63B 22/20 482/132 |
| 9,067,104 | B1 * | 6/2015 | Kim | A63B 22/20 |
| 9,079,092 | B2 * | 7/2015 | Stack | A63B 71/145 |
| 9,364,716 | B2 * | 6/2016 | Kramer | A63B 26/003 |
| 9,511,251 | B2 * | 12/2016 | Chang | A63B 21/0724 |
| 9,808,665 | B1 * | 11/2017 | Demarais | A63B 21/4035 |
| 2004/0266593 | A1 * | 12/2004 | Schwendeman | A63B 23/12 482/140 |
| 2006/0014615 | A1 * | 1/2006 | Godbold | A63B 21/00047 482/141 |
| 2006/0035771 | A1 * | 2/2006 | Gant | A63B 23/12 482/141 |
| 2009/0298656 | A1 * | 12/2009 | Dannenberg | A63B 22/14 482/141 |
| 2010/0261590 | A1 * | 10/2010 | Fares | A63B 21/00047 482/131 |
| 2010/0317496 | A1 * | 12/2010 | Abranchess | A63B 21/0004 482/141 |
| 2012/0083396 | A1 * | 4/2012 | Aquino | A63B 21/0004 482/131 |
| 2012/0309599 | A1 * | 12/2012 | Miller, Jr. | A63B 22/20 482/139 |
| 2013/0123079 | A1 * | 5/2013 | Peritz | A63B 22/14 482/139 |
| 2013/0260970 | A1 * | 10/2013 | Moskowich | A63B 21/068 482/141 |
| 2014/0121082 | A1 * | 5/2014 | Kramer | A63B 26/003 482/142 |
| 2014/0135189 | A1 * | 5/2014 | Thomason | A63B 23/1236 482/141 |
| 2016/0016037 | A1 * | 1/2016 | Chang | A63B 21/0724 482/141 |

FOREIGN PATENT DOCUMENTS

| | | | |
|---|---|---|---|
| CN | 105617639 | A | 6/2016 |
| CN | 206325159 | U | 7/2017 |
| CN | 206965037 | U | 2/2018 |
| CN | 206995707 | U | 2/2018 |
| DE | 20203112 | U1 | 9/2002 |
| DE | 202012000433 | U1 | 2/2012 |
| JP | 3215072 | U | 2/2018 |

* cited by examiner

500

600

800 z100

ROLLER EXERCISING DEVICE AND SET OF ROLLER EXERCISING DEVICES

RELATED APPLICATIONS

This application claims priority to Taiwan Application Serial Numbers 106211006 and 106211007, both filed Jul. 26, 2017, which are herein incorporated by reference.

BACKGROUND

Technical Field

The present disclosure relates to an exercising device. More particularly, the present disclosure relates to a roller exercising device and a set of exercising devices including the roller exercising device.

Description of Related Art

Along with the prevalence of the fitness industry, various exercising devices have been available on the market, and some of them try to draw attentions from consumers by providing novel exercising ways. However, the exercising ways provided by these devices are usually highly limited, such that the users cannot use them to perform various movements, and hence the variations and fun will be less.

For example, a conventional push-up bar is usually configured with an integrally formed support (or a rotary plate) and a handle portion, wherein the support is used to stand on the floor, and the handle connected with the support (or the rotary plate) is used for the user to hold and pushes the floor via the support (or the rotary plate), such that the user may perform a push-up operation. However, the conventional push-up bar is difficult for the user to perform the other movement, and hence less variations can be achieved. Besides, after the conventional push-up bar has been used for a while, the user may not be willing to use it because the exercising way thereof is less interesting.

For another example, a conventional ab-roller usually has two handles and a roller that can pivotally rotate between the handles. The user may hold the handles with both hands and push out the conventional ab-roller out in a standing position or kneeling position. Next, the user may pull the conventional ab-roller back to be back to the standing position or kneeling position again, such that the training effects can be achieved. However, it is still difficult for the user to use the conventional ab-roller to perform other movements, and hence less variability can be achieved as well.

Therefore, to the people having ordinary skills in the art, it is important to design an exercising device that can provide less limitation, more variability, and more fun.

SUMMARY

The present disclosure provides a roller exercising device used with a predetermined assembly. The roller exercising device includes a base, a rotary plate, two supports, and two female buckles. The base has a first central through hole. The rotary plate is rotatably connected with the base and has a second central through hole, a first diameter, and a second diameter, wherein the first diameter is perpendicular to the second diameter, and the second central through hole corresponds to the first central through hole. The two supports are respectively disposed at two ends of the first diameter and extend toward a normal direction of a top surface of the rotary plate, wherein two male buckles are respectively disposed at the tops of the two supports. The two female buckles are respectively disposed at two ends of the second diameter and denting the top surface of the rotary plate, wherein the two female buckles correspond to the two male buckles, and the predetermined assembly is detachably assembled with the two female buckles and the two male buckles.

The present disclosure provides a roller exercising device set including a first roller exercising device and a second roller exercising device. Each of the first roller exercising device and the second roller exercising device includes a base, a rotary plate, two supports, and two female buckles. The base has a first central through hole. The rotary plate is rotatably connected with the base and having a second central through hole, a first diameter, and a second diameter, wherein the first diameter is perpendicular to the second diameter, and the second central through hole corresponds to the first central through hole. The two supports are respectively disposed at two ends of the first diameter and extend toward a normal direction of a top surface of the rotary plate, wherein two male buckles are respectively disposed at the tops of the two supports. The two female buckles are respectively disposed at two ends of the second diameter and denting the top surface of the rotary plate, wherein the two female buckles correspond to the two male buckles. The two male buckles of the first roller exercising device buckle the two female buckles of the second roller exercising device, the two male buckles of the second roller exercising device buckle the two female buckles of the first roller exercising device, and the first roller exercising device and the second roller exercising device are combined with each other to form an exercising device in a face-to-face way.

The present disclosure provides a roller exercising device set including a roller exercising device and a handle. The roller exercising device includes a base, a rotary plate, two supports, and two first female buckles. The base has a first central through hole. The rotary plate is rotatably connected with the base and having a second central through hole, a first diameter, and a second diameter, wherein the first diameter is perpendicular to the second diameter, and the second central through hole corresponds to the first central through hole. The two supports are respectively disposed at two ends of the first diameter and extending toward a normal direction of a top surface of the rotary plate, wherein two male buckles are respectively disposed at the tops of the two supports and spaced by a first distance. The two first female buckles are respectively disposed at two ends of the second diameter and dent the top surface of the rotary plate, wherein the two first female buckles correspond to the two male buckles. The handle's surface is disposed with two second female buckles corresponding to the two male buckles, wherein the two second female buckles are spaced by a second distance equal to the first distance, and the male buckles of the roller exercising device detachably buckle the two second female buckles of the handle.

The present disclosure provides a roller exercising device used with a predetermined assembly. The roller exercising device includes a base, a rotary plate, two supports, and two abutting portions. The base has a first central through hole. The rotary plate is rotatably connected with the base and having a second central through hole, a first diameter, and a second diameter, wherein the second central through hole corresponds to the first central through hole. The two supports are respectively disposed at two ends of the first diameter and extend toward a normal direction of a top surface of the rotary plate, wherein at least one of the two supports is disposed with a male buckle. The two abutting portions are disposed on the top surface of the rotary plate and respectively locating at two ends of the second diameter.

The present disclosure provides a roller exercising device set including a first roller exercising device, a second roller exercising device, and a pulling rope. Each of the first roller exercising device and the second roller exercising device includes a base, a rotary plate, two supports, and two female buckles. The base has a first central through hole and a bottom surface disposed with a limiting slot. The rotary plate rotatably is connected with the base and has a second central through hole, a first diameter, and a second diameter, wherein the first diameter is perpendicular to the second diameter, and the second central through hole corresponds to the first central through hole. The two supports are respectively disposed at two ends of the first diameter and extend toward a normal direction of a top surface of the rotary plate, wherein two male buckles are respectively disposed at the tops of the two supports. The two female buckles are respectively disposed at two ends of the second diameter and denting the top surface of the rotary plate, wherein the two female buckles correspond to the two male buckles. The pulling rope goes through the limiting slot of the first roller exercising device and the limiting slot of the second roller exercising device.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1A:
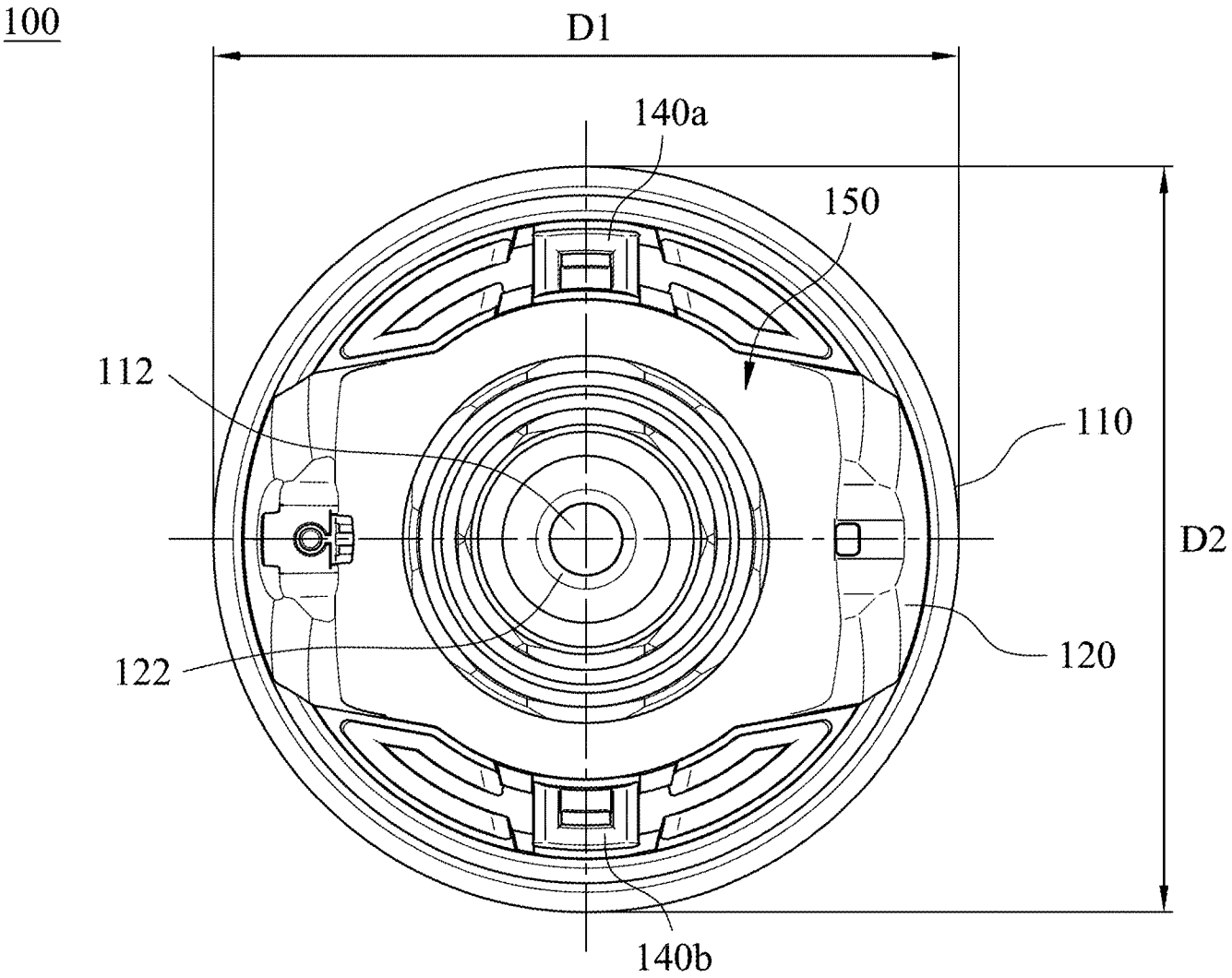
FIG. 1A is a top view of a first roller exercising device of an embodiment of the present disclosure.
Figure 1B:
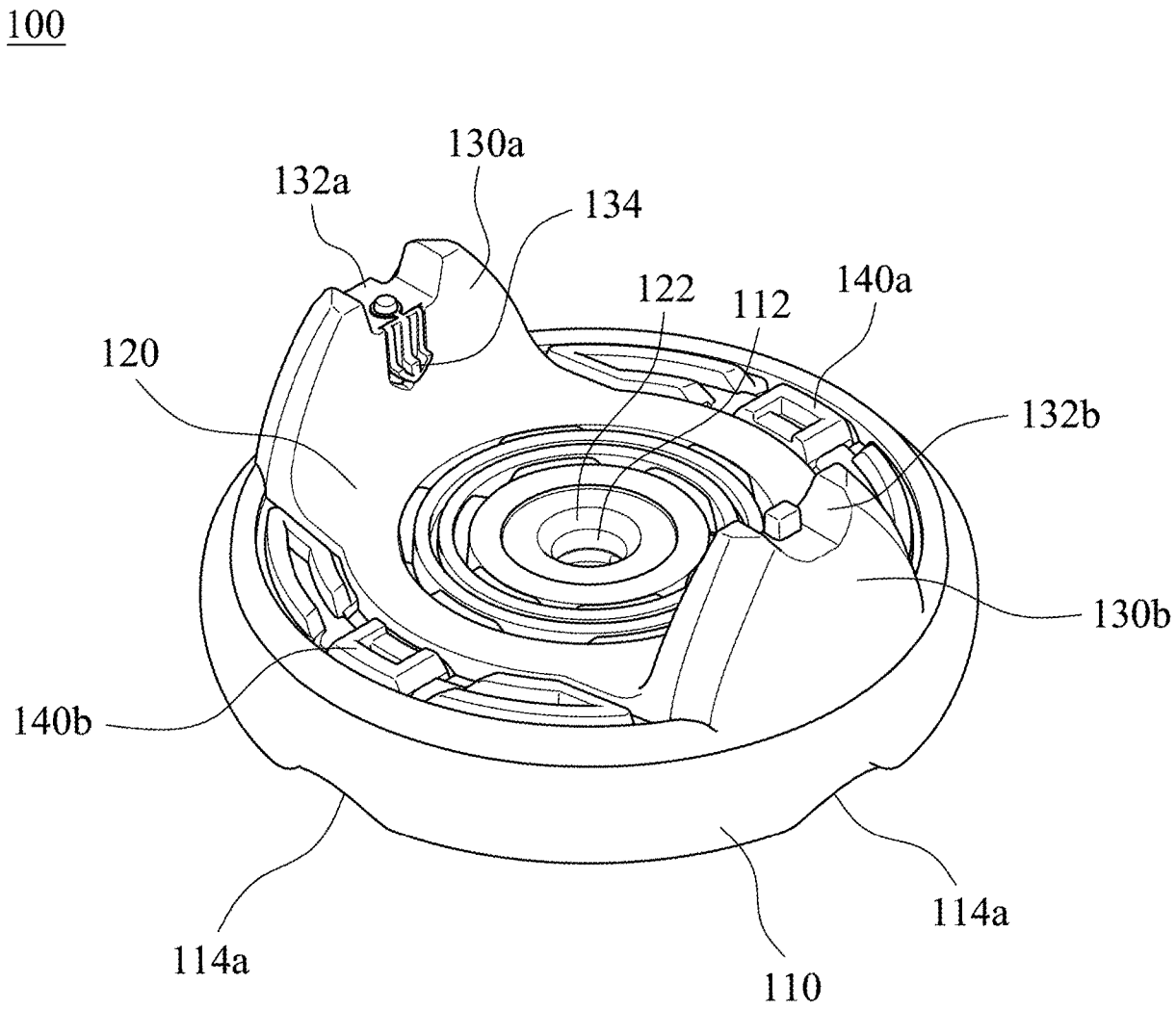
FIG. 1B is a 3-D view of the first roller exercising device of FIG. 1A.
Figure 1C:
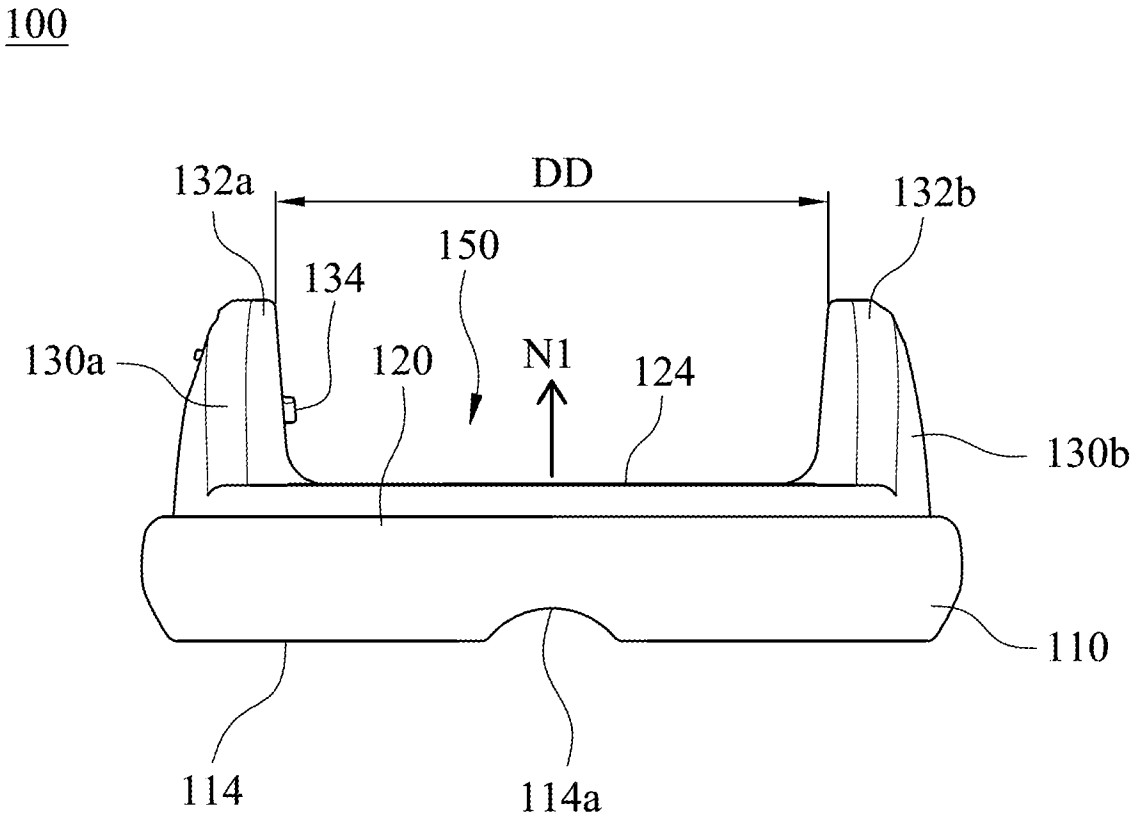
FIG. 1C is a side view of the first roller exercising device of FIG. 1A.

See FIG. 1A, FIG. 1B, and FIG. 1C, wherein FIG. 1A is a top view of a first roller exercising device 100 of an embodiment of the present disclosure, FIG. 1B is a 3-D view of the first roller exercising device 100 of FIG. 1A, and FIG. 1C is a side view of the first roller exercising device 100 of FIG. 1A. In the present embodiment, the first roller exercising device 100 may be used with a predetermined assembly to form various exercising devices for the user to perform various movements. Detailed discussion will be provided hereinafter.

As shown in FIG. 1A to FIG. 1C, the first roller exercising device 100 includes a base 110, a rotary plate 120, a support 130*a*, a support 130*b*, a female buckle 140*a*, and a female buckle 140*b*. The base 110 has a first central through hole 112. The rotary plate 120 is rotatably connected with the base 110 and has a second central through hole 122, a first diameter D1, and a second diameter D2, wherein the first diameter D1 is perpendicular to the second diameter D2, and the second central through hole 122 corresponds to the first central through hole 112. The support 130*a* and the support 130*b* are respectively disposed at two ends of the first diameter D1 and extend toward a normal direction N1 of a top surface 124 of the rotary plate 120, wherein a male buckle 132*a* and a male buckle 132*b* are respectively disposed at the tops of the support 130*a* and the support 130*b*. The female buckle 140*a* and the female buckle 140*b* are respectively disposed at two ends of the second diameter D2 and dent the top surface 124 of the rotary plate 120, wherein the female buckle 140*a* and the female buckle 140*b* correspond to the male buckle 132*a* and the male buckle 132*b*, and the predetermined assembly can be detachably assembled with the female buckle 140*a*, the female buckle 140*b*, the male buckle 132*a*, and the male buckle 132*b*.

In one embodiment, the male buckle 132*a* and the male buckle 132*b* may be male buckling elements, and a release button 134 may be disposed on the support 130*a* (or the support 130*b*) to release a buckling status of the support 130*a* (or the support 130*b*). Furthermore, a predetermined distance DD may exist between the support 130*a* and the support 130*b*, such that a stepping portion 150 may be formed between the support 130*a* and the support 130*b*. Besides, a bottom surface 114 of the base 110 may be disposed with at least two limiting slots 114*a*, and the limiting slots 114*a* are disposed at two ends of the diameter of the bottom surface 114. Noted that there are a limiting slots (not shown because of the viewing angle of FIG. 1B) on the other sides of the two limiting slots 114*a*.

Figure 2A:
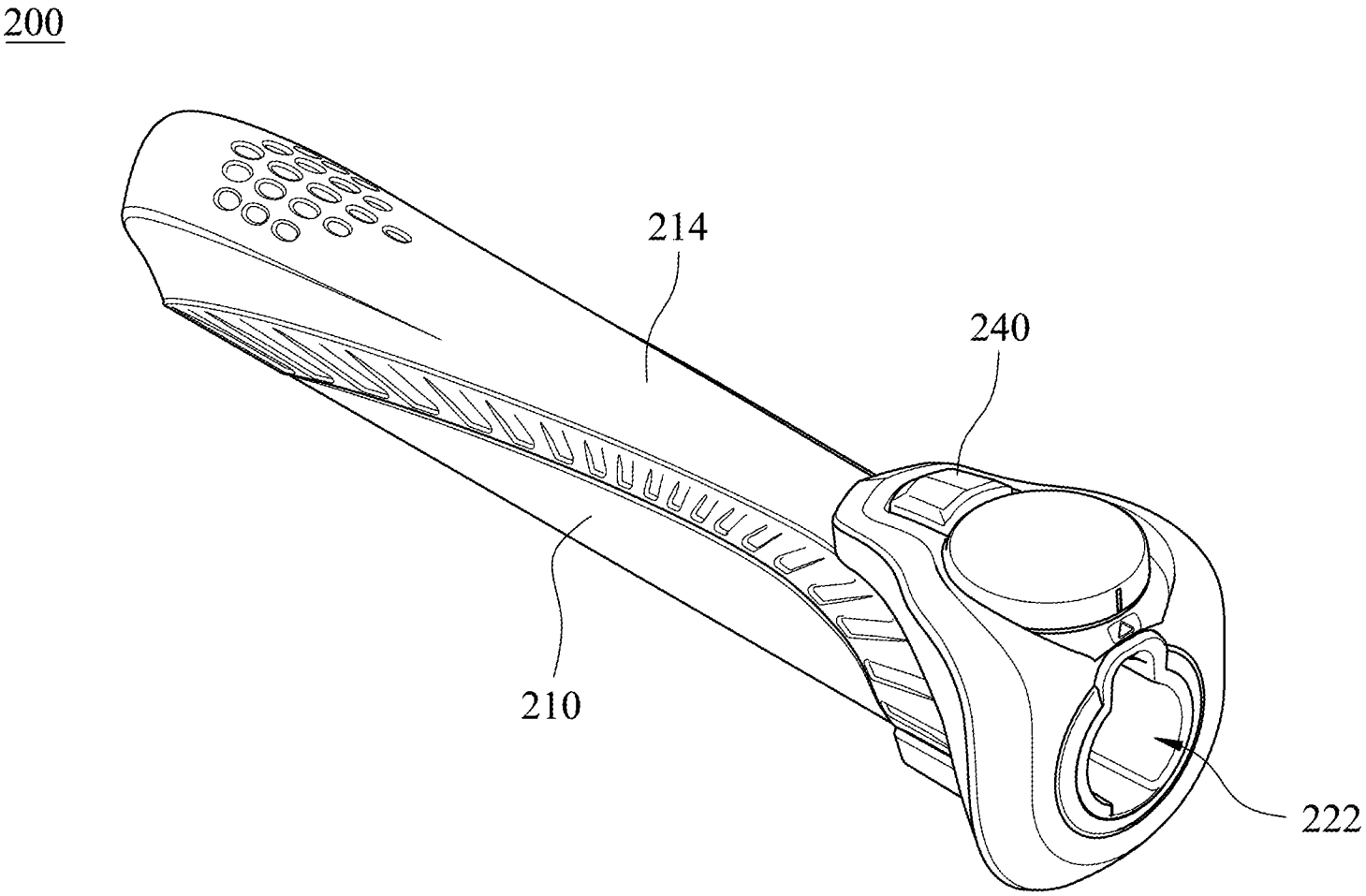
FIG. 2A is a 3-D view of the handle exercising device of one embodiment of the present disclosure.
Figure 2B:
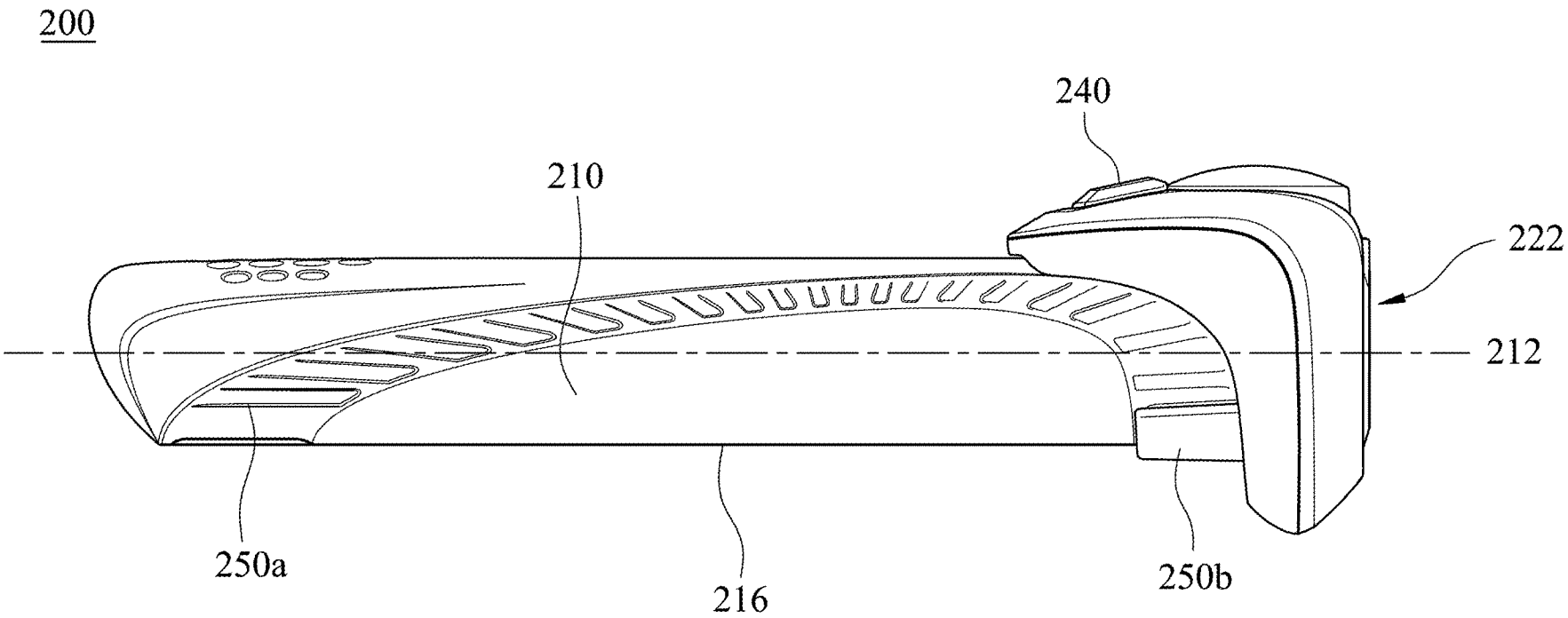
FIG. 2B is a side view of the handle exercising device of FIG. 2A.
Figure 2C:
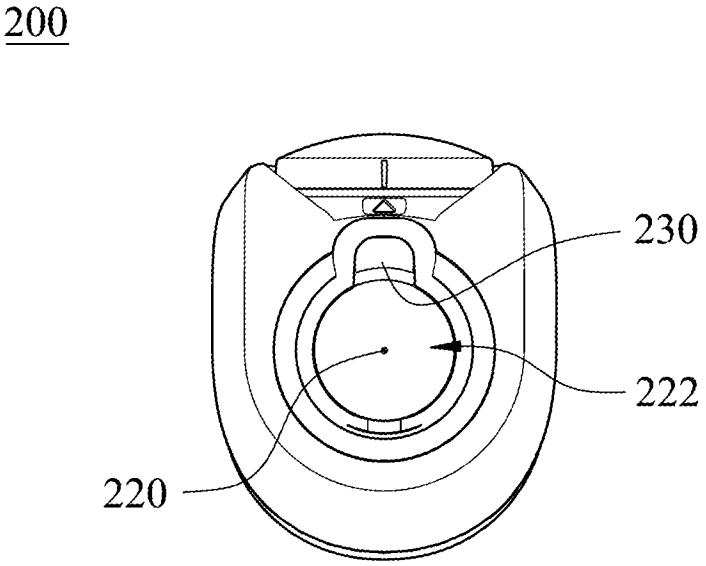
FIG. 2C is a front view of the handle exercising device of FIG. 2A.

In various embodiments, the predetermined assembly may be any exercising devices that can be assembled with the first roller exercising device 100 to provide predetermined functions, such as a handle exercising device 200 shown in FIG. 2A, FIG. 2B, and FIG. 2C.

See FIG. 2A, FIG. 2B, and FIG. 2C, wherein FIG. 2A is a 3-D view of the handle exercising device 200 of one embodiment of the present disclosure, FIG. 2B is a side view of the handle exercising device 200 of FIG. 2A, and FIG. 2C is a front view of the handle exercising device 200 of FIG. 2A. As shown in FIG. 2A, FIG. 2B, and FIG. 2C, the handle exercising device 200 includes a handle body 210, a chamber 220, a buckle portion 230, a release button 240, a female buckle 250*a*, and a female buckle 250*b*. The handle body 210 has a top surface 214 and a bottom surface 216. The chamber 220 is disposed in the handle body 210 along an axial direction 212 of the handle body 210, wherein the chamber 220 has an opening 222 facing one end of the handle body 210. The buckle portion 230 is disposed in the chamber 220 and buckles the predetermined assembly inserting the chamber 220 via the opening 222. The release button 240 is disposed at the top surface 214 of the handle body 210 and connected with the buckle portion 230 to release a buckling status of the buckling portion 230. The female buckle 250*a* and the female buckle 250*b* are disposed at the bottom surface 216 of the handle body 210 and arranged in parallel along the axial direction 212.

In one embodiment, a distance between the female buckle 250*a* and the female buckle 250*b* may be wider than a palm for facilitating the user to hold. Besides, the female buckle 250*a* and the female buckle 250*b* may correspond to the male buckle 130*a* and the male buckle 130*b* of the first roller exercising device 100 shown in FIG. 1A. That is, the male buckle 130*a* and the male buckle 130*b* of the first roller exercising device 100 may respectively buckle the female buckle 250*a* and the female buckle 250*b* of the handle exercising device 200.

Figure 3A:
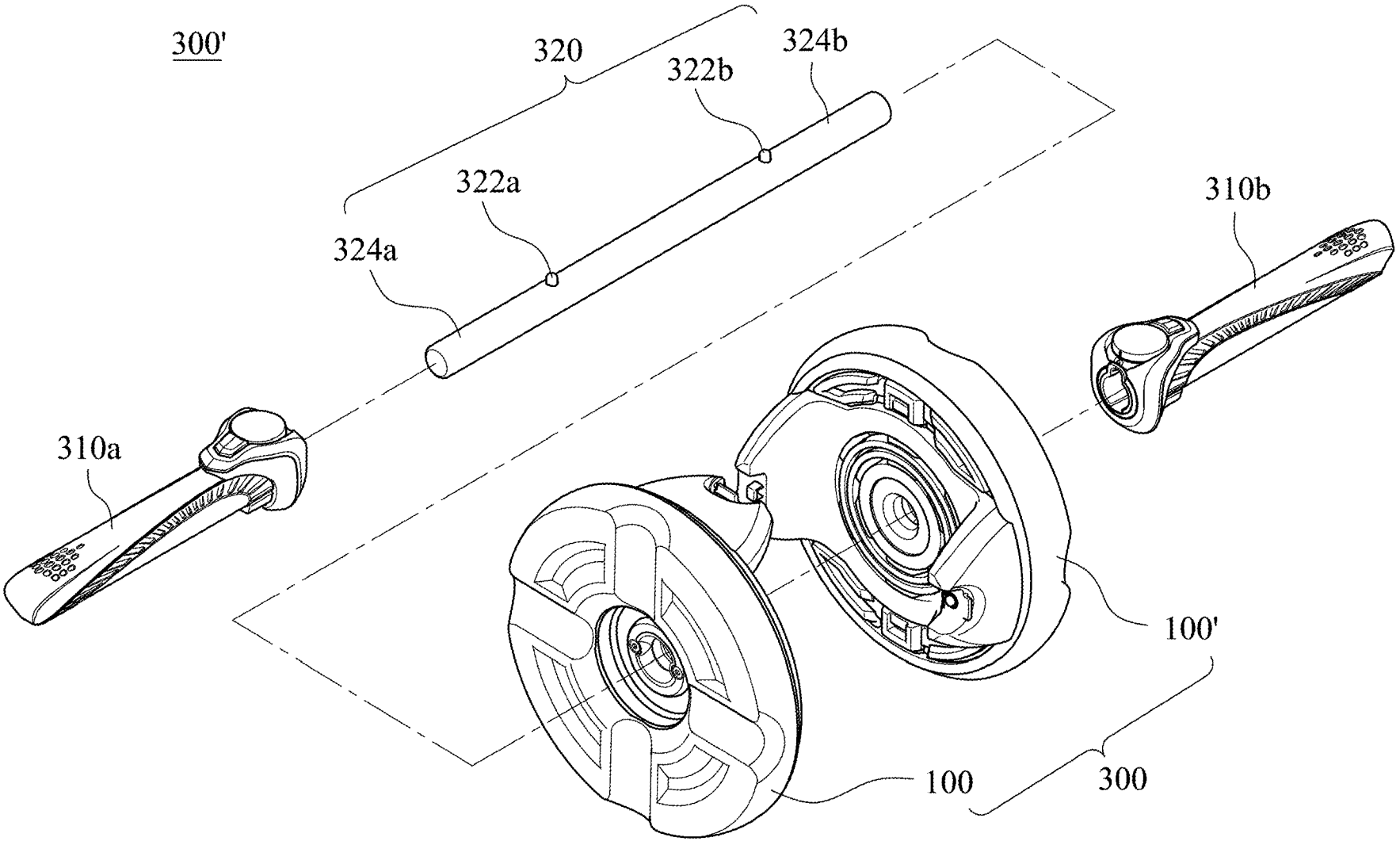
FIG. 3A is a schematic diagram of assembling the first roller exercising device with other predetermined assemblies to form an exercising device according to one embodiment of the present disclosure.
Figure 3B:
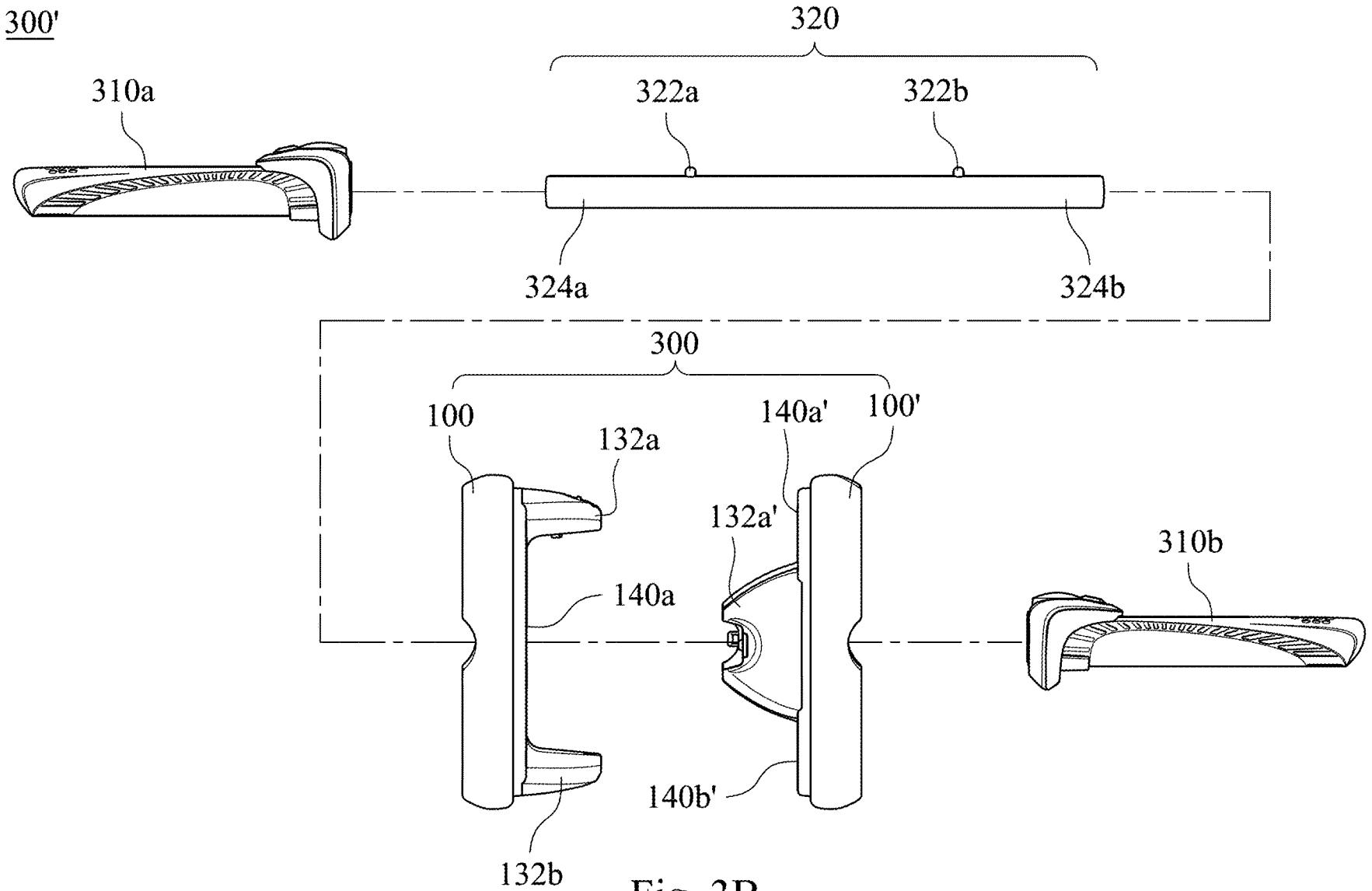
FIG. 3B is a side view of the exercising device of FIG. 3A.
Figure 3C:
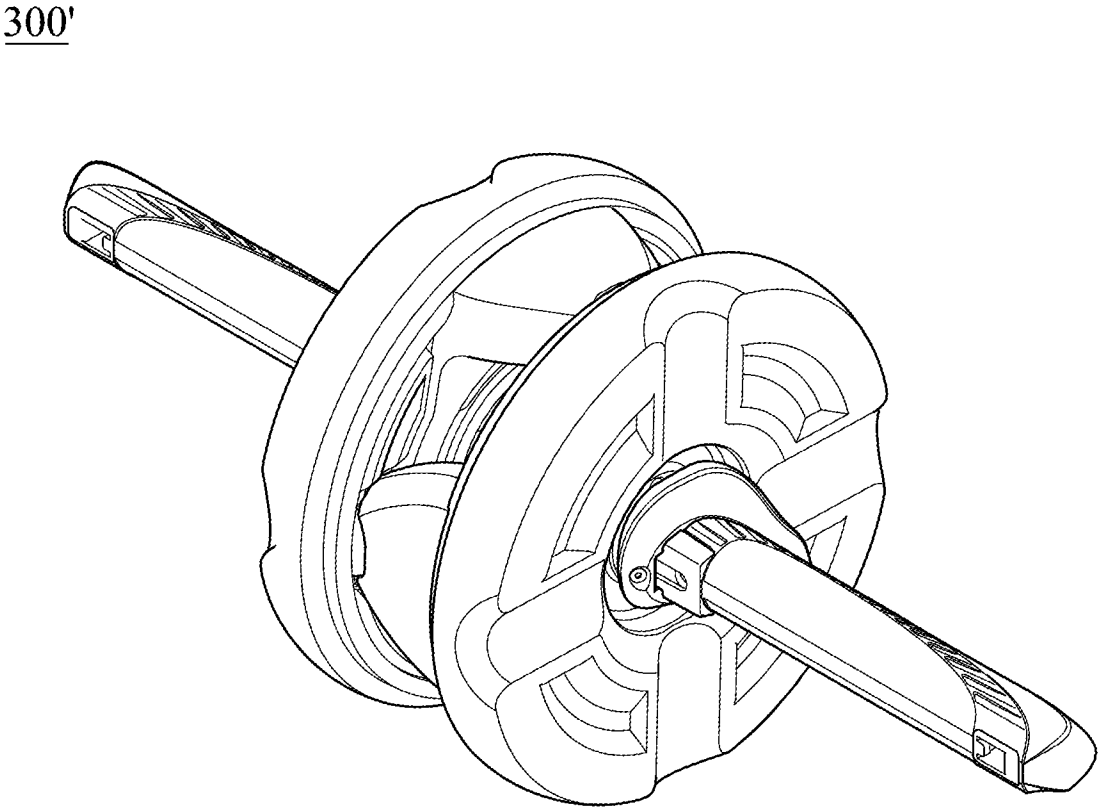
FIG. 3C is a schematic diagram of the assembled exercising device according to FIG. 3A.

See FIG. 3A, FIG. 3B, and FIG. 3C, wherein FIG. 3A is a schematic diagram of assembling the first roller exercising device 100 with other predetermined assemblies to form an exercising device 300' according to one embodiment of the present disclosure, FIG. 3B is a side view of the exercising device 300' of FIG. 3A, and FIG. 3C is a schematic diagram of the assembled exercising device 300' according to FIG. 3A. In the present embodiment, the predetermined assemblies include a second roller exercising device 100', a handle 310*a*, a handle 310*b*, and a connecting rod 320, wherein the handle 310*a* and the handle 310*b* may be the same as the handle exercising device 200 shown in FIG. 2A, but the present disclosure is not limited thereto.

The second roller exercising device 100' may be the same as the first roller exercising device 100. In this case, the male buckle 130*a* and the male buckle 130*b* of the first roller exercising device 100 may respectively buckle the female buckle 140*a*' and the female buckle 140*b*' of the second roller exercising device 100'. Meanwhile, the male buckle 130*a*' of the second roller exercising device 100' may buckle the female buckle 140*a* of the first roller exercising device 100, such that the first roller exercising device 100 and the second roller exercising device 100' may be combined with each other to form a roller exercising device 300 in a face-to-face way.

Moreover, the connecting rod 320 may penetrate the first central through hole 112 and the second central through hole 122 of the first roller exercising device 100 and penetrate the first central through hole (not labelled) and the second central through hole (not labelled) of the second roller exercising device 100', such that the roller exercising device 300 may pivotally rotate on the connecting rod 320.

In one embodiment, reeds 322*a* and 322*b* may be disposed on the connecting rod 320, and two ends of the connecting rod 320 may form an inserting portion 324*a* and an inserting portion 324*b*. In this case, the handle 310*a* and the handle 310*b* may sleeve on the two ends of the connecting rod 320. Specifically, the inserting portion 324*a* and the inserting portion 324*b* of the connecting rod 320 may respectively insert the chambers (not labelled) of the handle 310*a* and the handle 310*b*, and the reeds 322*a* and 322*b* may be respectively buckled by the buckle portions (not labelled) of the handle 310*a* and the handle 310*b*.

In this way, the roller exercising device 300, the connecting rod 320, the handle 310*a*, and the handle 310*b* may be combined as the exercising device 300' for the user to perform a rolling operation. For example, the user may use the exercising device 300' based on the way of using the conventional ab-roller. That is, the user may hold the handle 310*a* and the handle 310*b* with both hands and push out the exercising device 300' out in a standing position or kneeling position. Next, the user may pull the exercising device 300' back to be back to the standing position or kneeling position again, such that the training effects can be achieved.

In one embodiment, when the user wants to remove the handle 310*a* and the handle 310*b* from the connecting rod 320, the user may press the release buttons (not labelled) on the handle 310*a* and the handle 310*b* to release the reeds 322*a* and 322*b* buckled by the buckle portions (not labelled) on the handle 310*a* and the handle 310*b*.

Other than the handle 310*a*, the handle 310*b*, and the connecting rod 320, the roller exercising device 300 may be assembled with other types of handles and connecting rods to form a device similar to the exercising device 300'. For example, the connecting rod 320 may be replaced with any rod that is suitable for penetrating the roller exercising device 300, and the handle 310*a* and the handle 310*b* may be correspondingly replaced with any objects that can sleeve on two ends of the rod and be held by the user, but the present disclosure is not limited thereto.

By contrast, the handle 310*a*, the handle 310*b*, and the connecting rod 320 may be used with other types of roller exercising devices to form a device similar to the exercising device 300', rather than limited to be assembled with the roller exercising device 300 shown in FIG. 3A, FIG. 3B, and FIG. 3C. For example, the roller exercising device 300 may be replaced with any roller exercising device disposed with a central through hole for the connecting rod 320 to penetrate. Afterwards, the handle 310*a* and the handle 310*b* may be connected with the two ends of the connecting rod 320 based on the above teachings for the user to hold, but the present disclosure is not limited thereto.

Figure 4A:
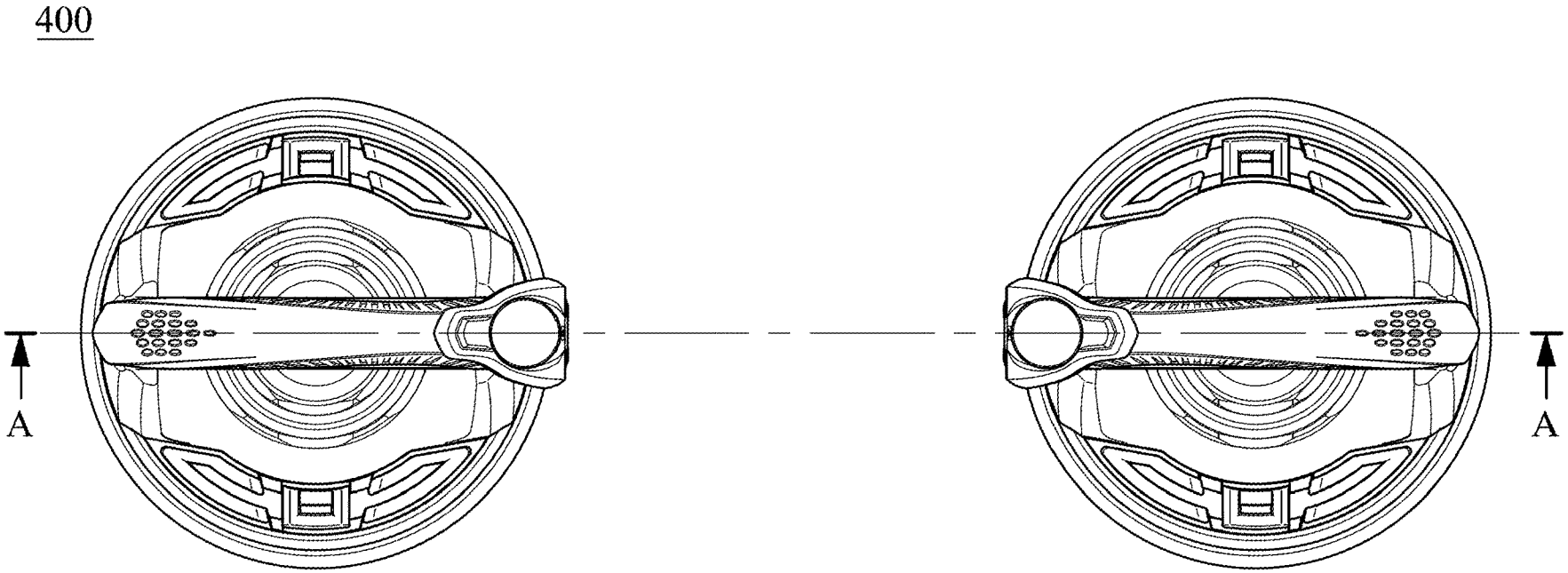
FIG. 4A is a top view of assembling a roller exercising device set.
Figure 4B:
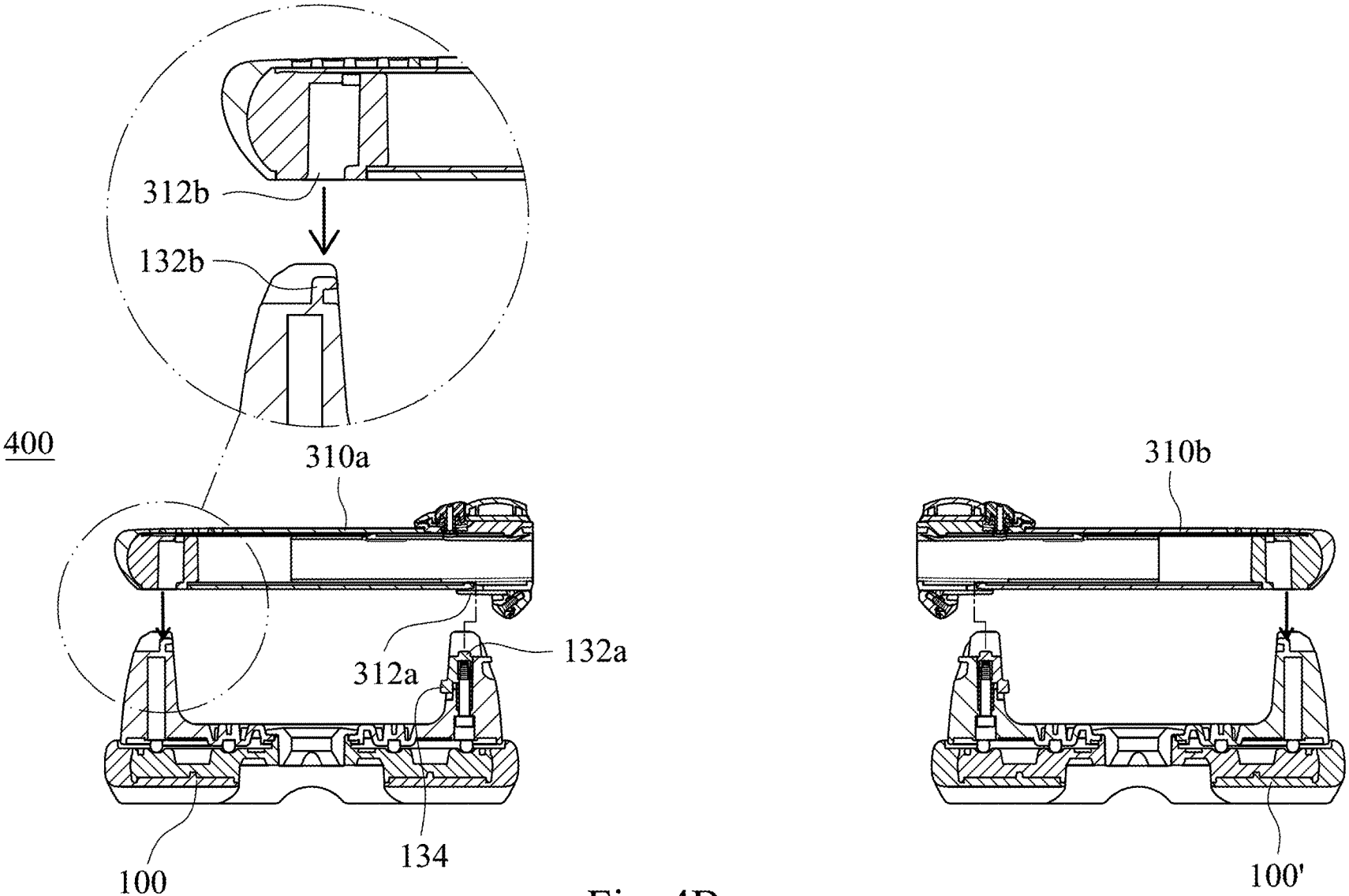
FIG. 4B is a side cross-sectional view along the A-A segment of FIG. 4A.
Figure 4C:
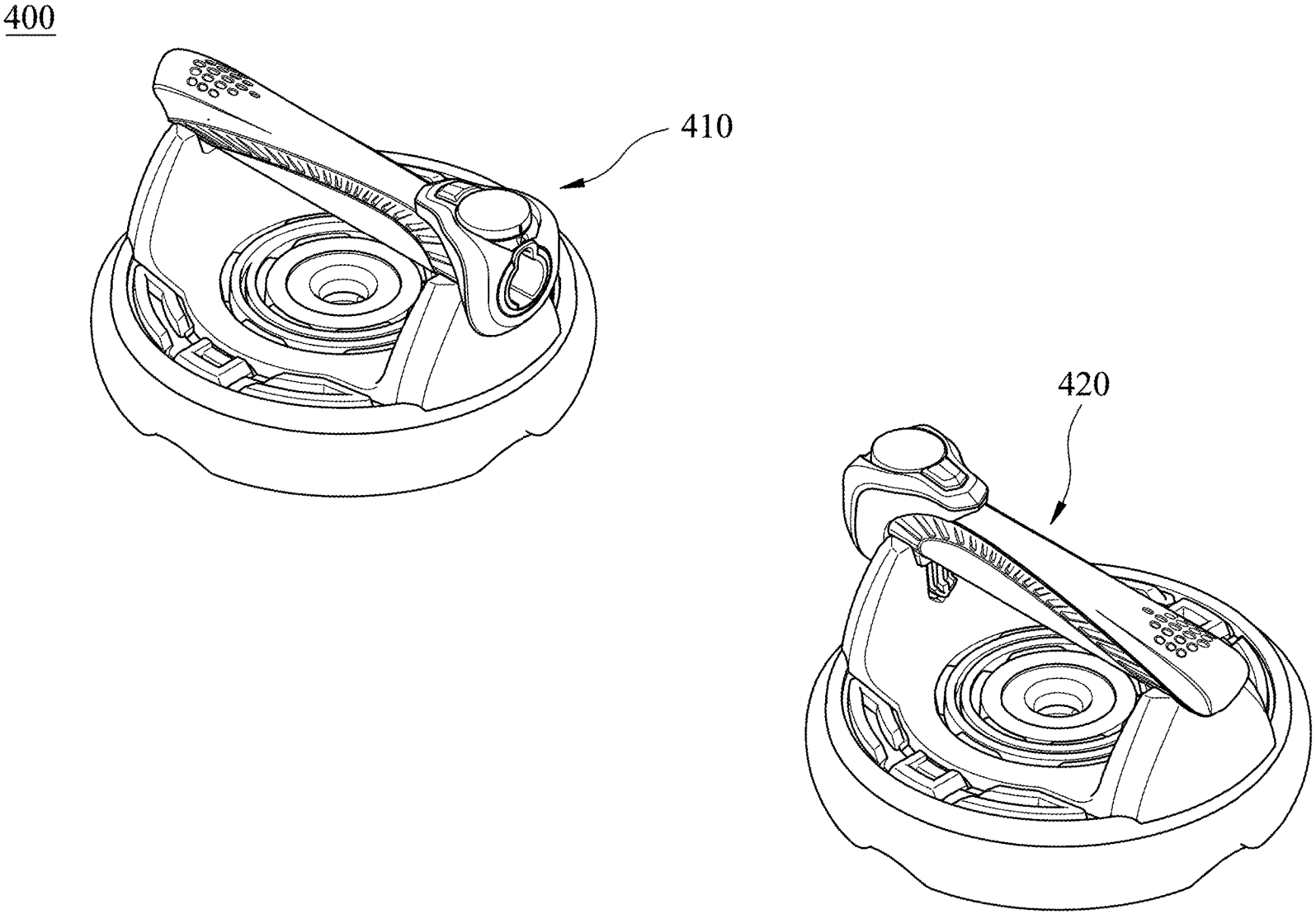
FIG. 4C is a 3-D view of the assembled roller exercising device set of FIG. 4A.

See FIG. 4A, FIG. 4B, and FIG. 4C, wherein FIG. 4A is a top view of assembling a roller exercising device set 400, FIG. 4B is a side cross-sectional view along the A-A segment of FIG. 4A, and FIG. 4C is a 3-D view of the assembled roller exercising device set 400 of FIG. 4A. In the present embodiment, the roller exercising device set 400 includes the first roller exercising device 100, the second roller exercising device 100', the handle 310*a*, and the handle 310*b*. As mentioned before, the handle 310*a* and the handle 310*b* may be the same as the handle exercising device 200 shown in FIG. 2A. In this case, since the male buckle 132*a* and the male buckle 132*b* of the first roller exercising device 100 may respectively buckle the female buckle 250*a* and the female buckle 250*b* of the handle exercising device 200, the male buckle 132*a* and the male buckle 132*b* of the first roller exercising device 100 may respectively buckle the female buckle 312*a* and the female buckle 312*b* of the handle 310*a*. Accordingly, the first roller exercising device 100 and the handle 310*a* may be assembled as an exercising device 410. Similarly, the second roller exercising device 100' and the handle 310*b* may be assembled as an exercising device 420.

As a result, the user may hold the handle 310*a* and the handle 310*b* on the exercising devices 410 and 420 to perform a push-up operation. Further, since each of the first roller exercising device 100 and the second roller exercising device 100' is disposed with the rotary plate 120, the rotary plate 120 on each of the first roller exercising device 100 and the second roller exercising device 100' may rotate along with the rotation of the wrists of the user, and hence a safer movement pattern can be achieved.

In one embodiment, the handle 310*a* may be disposed with a sensor to detect the number of the rotary plate 120 of the first roller exercising device 100 rotating on the base 110, such that the number of the push-ups performed by the user can be monitored.

In one embodiment, when the user wants to remove the handle 310*a* from the first roller exercising device 100, the user may press the release button 134 on the first roller exercising device 100 to release the buckling status of the male buckle 132*a*, such that the female buckle 312*a* on the handle 310*a* may be released, and hence the handle 310*a* can be removed from the first roller exercising device 100.

Other than the handle 310*a* and the handle 310*b*, it is noted that the first roller exercising device 100 and the second roller exercising device 100' may be assembled with other types of handles to form exercising devices similar to the exercising device 410 and the exercising device 420. For example, the handle 310*a* and the handle 310*b* may be replaced with other handles disposed with female buckles. As long as the female buckles on these handles can correspond to the male buckles on the first roller exercising device 100 and the second roller exercising device 100', these handles can be assembled with the first roller exercising device 100 and the second roller exercising device 100' to form exercising devices similar to the exercising device 410 and the exercising device 420. Therefore, the user may use these exercising devices to perform the push-up operation, but the present disclosure is not limited thereto.

By contrast, the handle 310*a* and the handle 310*b* may be assembled with other types of roller exercising devices to form exercising devices similar to the exercising device 410 and the exercising device 420. For example, the first roller exercising device 100 and the second roller exercising device 100' may be replaced with roller exercising devices disposed with male buckles. As long as the male buckles on these roller exercising devices can correspond to the female buckles on the handle 310*a* and the handle 310*b*, these roller exercising devices may be assembled with the handle 310*a* and the handle 310*b* to form exercising devices similar to the exercising device 410 and the exercising device 420. Therefore, the user may use these exercising devices to perform the push-up operation, but the present disclosure is not limited thereto.

Figure 5A:
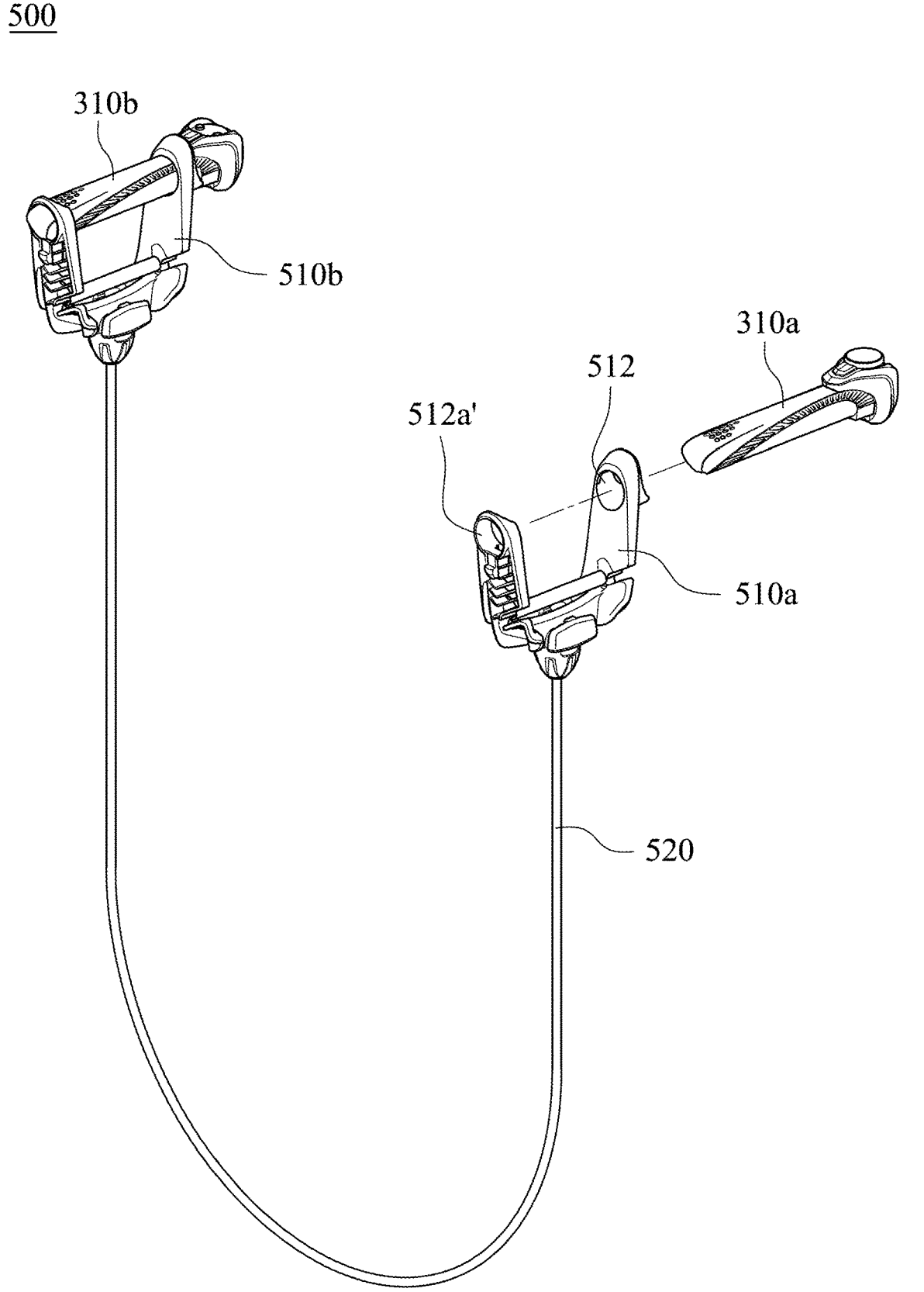
FIG. 5A is a schematic view of assembling an exercising device set of one embodiment of the present disclosure.
Figure 5B:
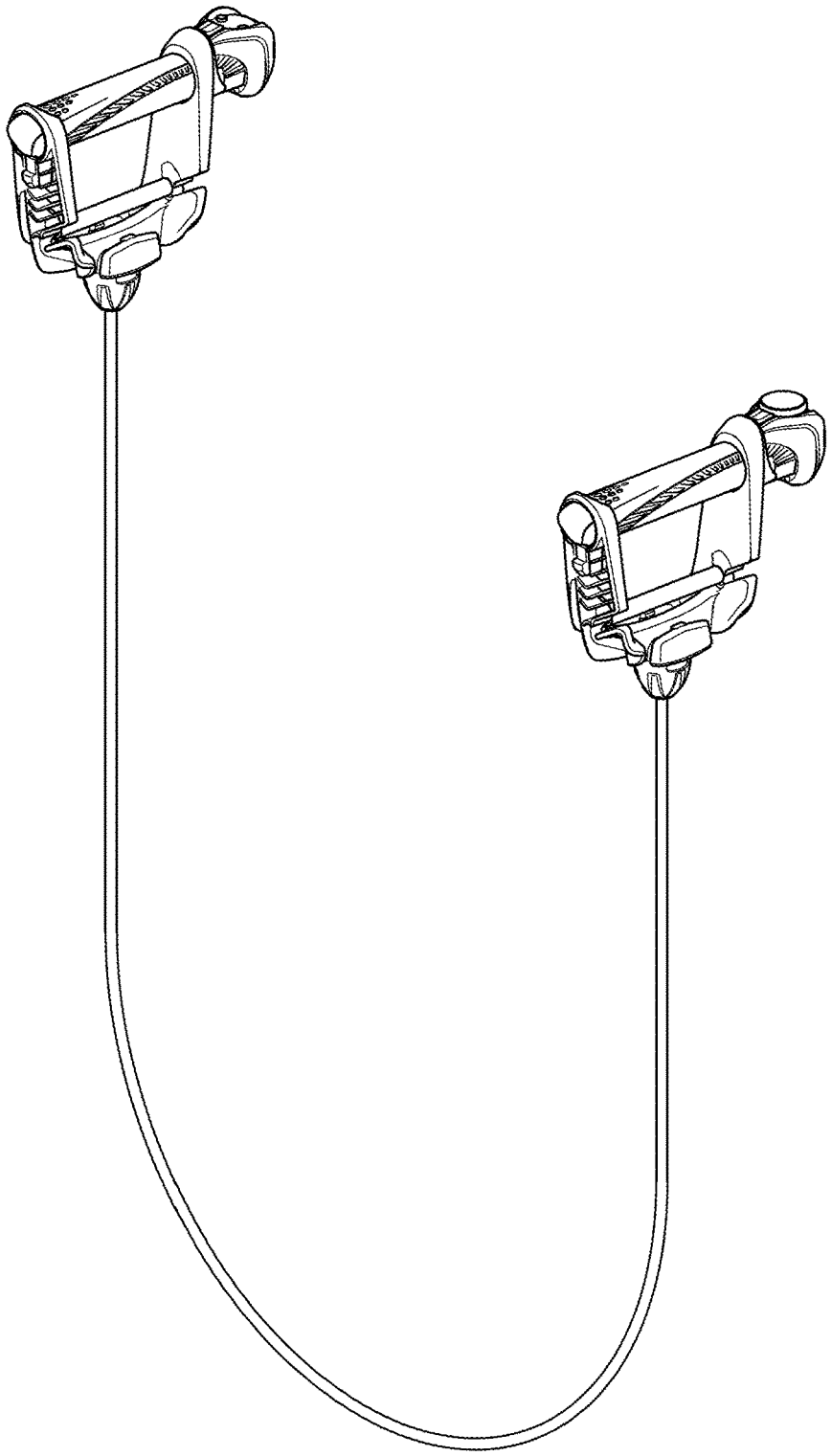
FIG. 5B is a schematic view of the assembled exercising device set.

See FIG. 5A and FIG. 5B, wherein FIG. 5A is a schematic view of assembling an exercising device set 500 of one embodiment of the present disclosure, and FIG. 5B is a schematic view of the assembled exercising device set 500. In the present embodiment, the exercising device set 500 includes the handle 310*a*, the handle 310*b*, a first handle case 510*a*, a second handle case 510*b*, and an elastic rope 520. The first handle case 510*a* is U-shaped, and two ends of the first handle case 510*a* are disposed with a through hole 512*a* and a through hole 512*a'*. The through hole 512*a* and the through hole 512*a'* are aligned with each other. The second handle case 510*b* may be the same as the first handle case 510*a*, and hence the details of the second handle case 510*b* will not be further described. Two ends of the elastic rope 520 may be respectively connected with the first handle case 510*a* and the second handle case 510*b*.

As shown in FIG. 5A, the handle body of the handle 310*a* may penetrate the through hole 512*a* and the through hole 512*a'* of the first handle case 510*a*, and the handle body of the handle 310*b* may penetrate the through holes of the second handle case 510*b*. The handle 310*a*, the handle 310*b*, the first handle case 510*a*, the second handle case 510*b*, and the elastic rope 520 may be combined as the exercising device set 500 (e.g., a pulling rope) shown in FIG. 5B. In this way, the user may use the exercising device set 500 to perform movements such as pulling the handle 310*a* and the handle 310*b* with both hands while stepping on the elastic rope 520, and hence the training effects may be achieved.

Figure 6A:
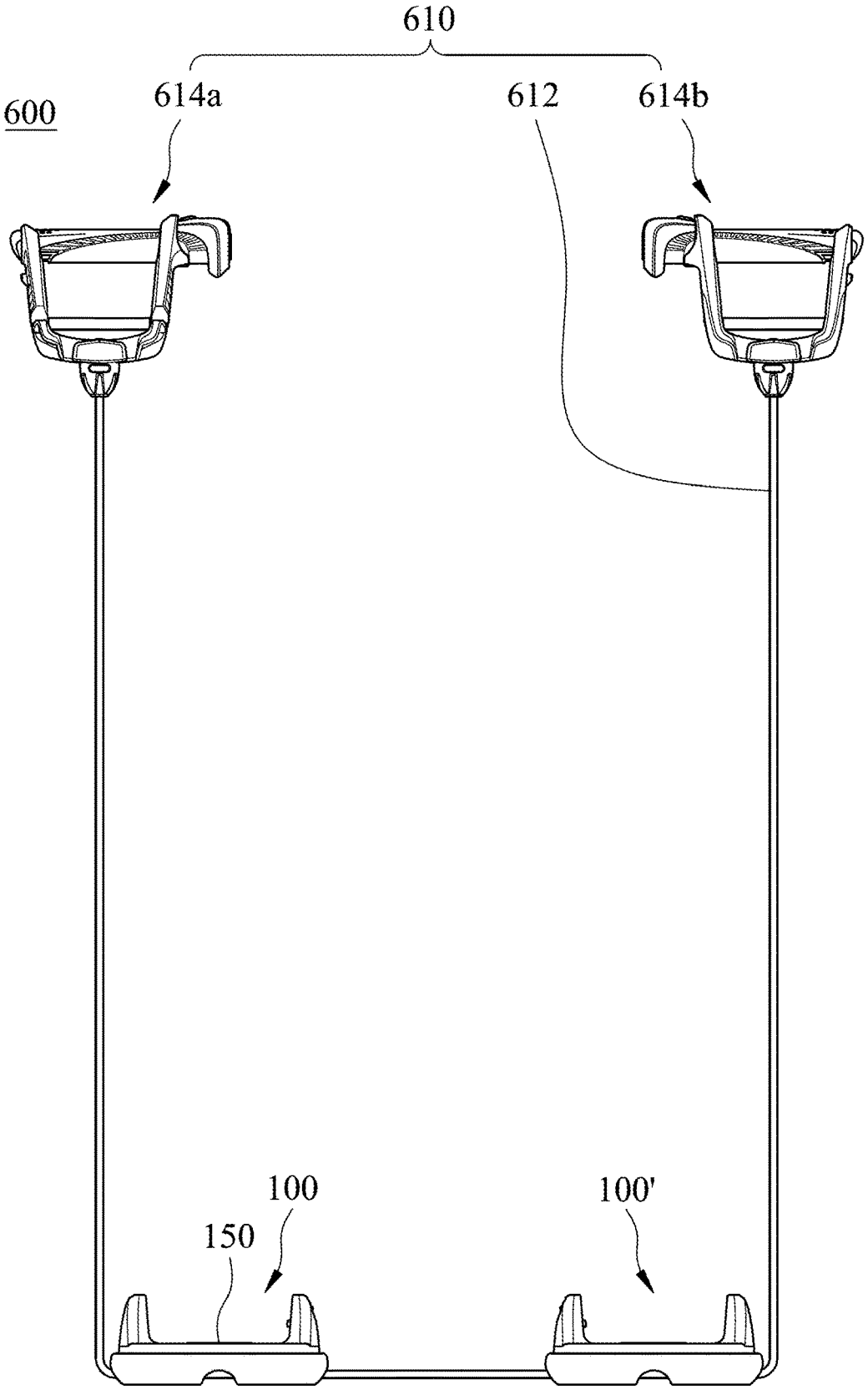
FIG. 6A is a front view of a roller exercising device set of one embodiment of the present disclosure.
Figure 6B:
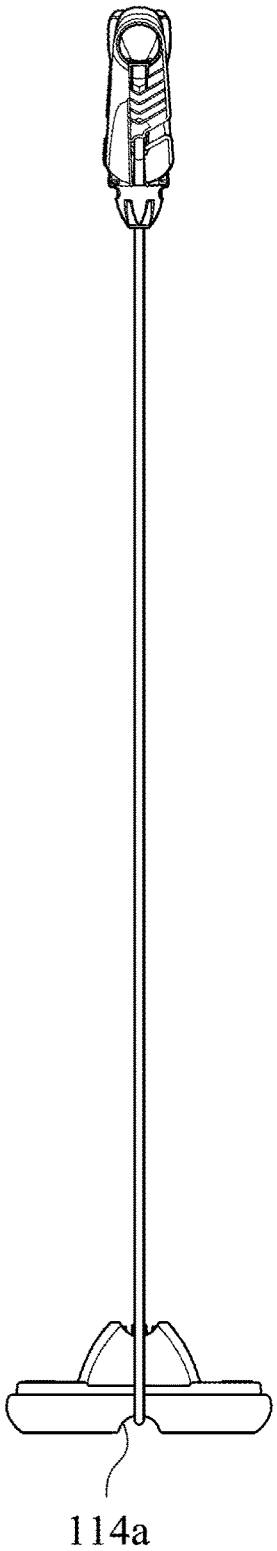
FIG. 6B is a side view of the roller exercising device set of FIG. 6A.

See FIG. 6A and FIG. 6B, wherein FIG. 6A is a front view of a roller exercising device set 600 of one embodiment of the present disclosure, and FIG. 6B is a side view of the roller exercising device set 600 of FIG. 6A. In the present embodiment, the roller exercising device set 600 includes the first roller exercising device 100, the second roller exercising device 100', and the pulling rope 610. The pulling rope 610 includes an elastic rope 610, a holding portion 614*a*, and a holding portion 614*b*. The holding portion 614*a* and the holding portion 614*b* are connected with two ends of the elastic rope 612.

As shown in FIG. 6A and FIG. 6B, the pulling rope 610 may be the same as the exercising device set 500 shown in FIG. 5A and FIG. 5B. That is, the holding portion 614*a* may be formed by assembling the handle 310*a* with the first handle case 510*a*, and the holding portion 614*b* may be formed by assembling the handle 310*b* with the second handle case 510*b*, but the present disclosure is not limited thereto.

In the present embodiment, the elastic rope 612 may go through the limiting slots 114*a* of the first roller exercising device 100 and the second roller exercising device 100' to form the roller exercising device set 600.

In this way, the user may step the stepping portion 150 of the first roller exercising device 100 and the stepping portion (not labelled) of the second roller exercising device 100' with both feet and hold the holding portion 614*a* and the holding portion 614*b* with both hands. As a result, the user may use the pulling rope 610 to perform movements (such as bicep curl) while using the first roller exercising device 100 and the second roller exercising device 100' to reciprocatingly twist his/her body, such that a better movement variability can be achieved. In one embodiment, the user may reciprocatingly twist his/her body by simply stepping on the first roller exercising device 100 and the second roller exercising device 100'.

Other than the pulling rope 610 shown in FIG. 6A and FIG. 6B, the first roller exercising device 100 and the second roller exercising device 100' may be used with other types of pulling ropes to form a device similar to the roller exercising device set 600. For example, the pulling rope 610 may be replaced with other conventional pulling ropes disposed with handles and elastic rope, but the present disclosure is not limited thereto.

By contrast, the pulling rope 610 may be used with other types of rotary plates to form a device similar to the roller exercising device set 600. For example, the first roller exercising device 100 and the second roller exercising device 100' may be replaced with any devices that can rotate along with the rotations of the user's feet and have limiting slots that allow the elastic rope 612 to go through, but the present disclosure is not limited thereto.

Figure 7A:
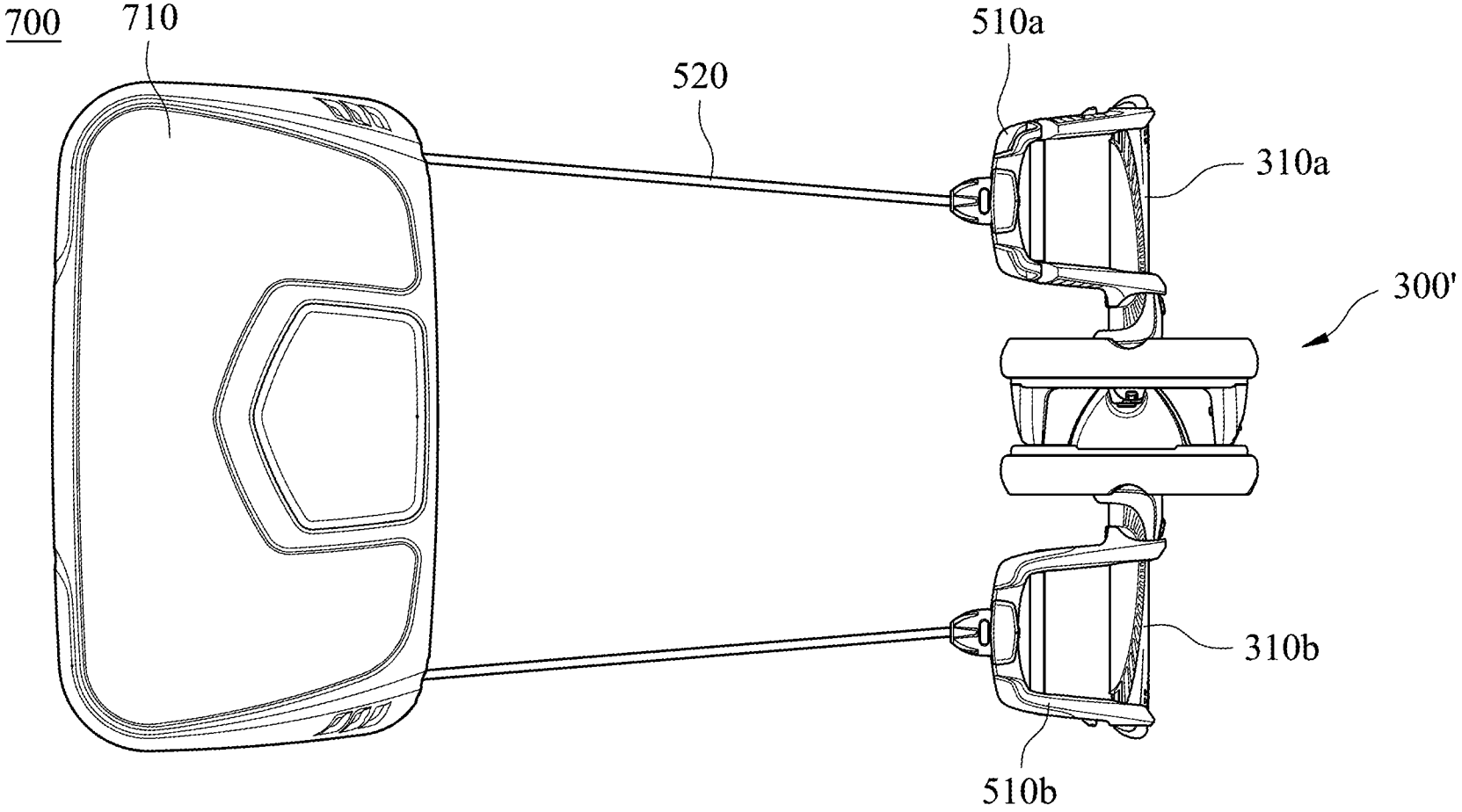
FIG. 7A is a top view of an exercising device set of one embodiment of the present disclosure.
Figure 7B:
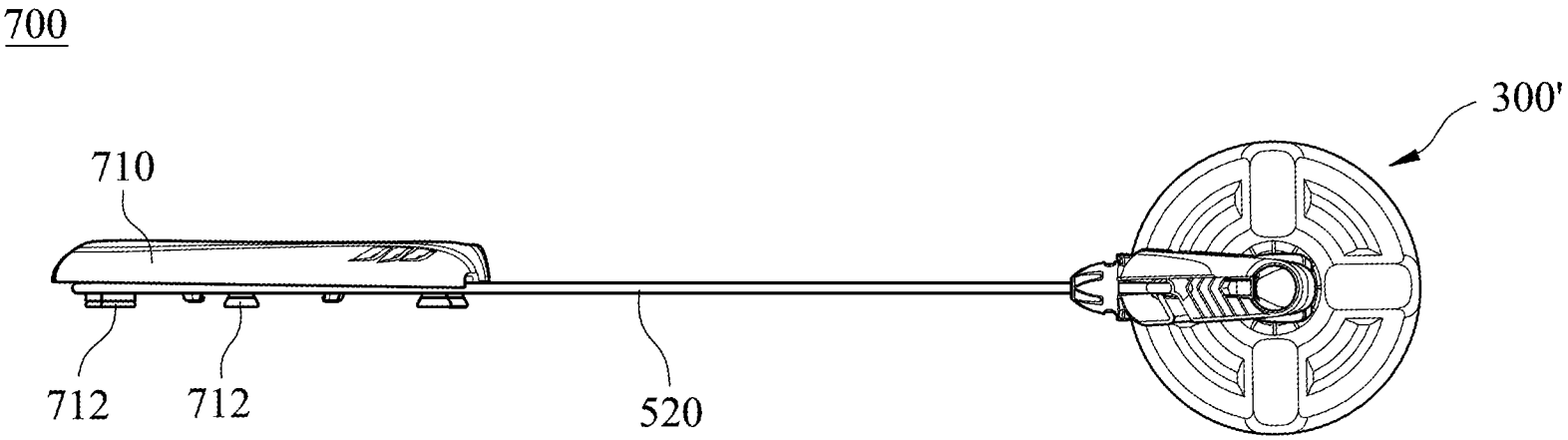
FIG. 7B is a side view of the exercising device set of FIG. 7A.
Figure 7C:
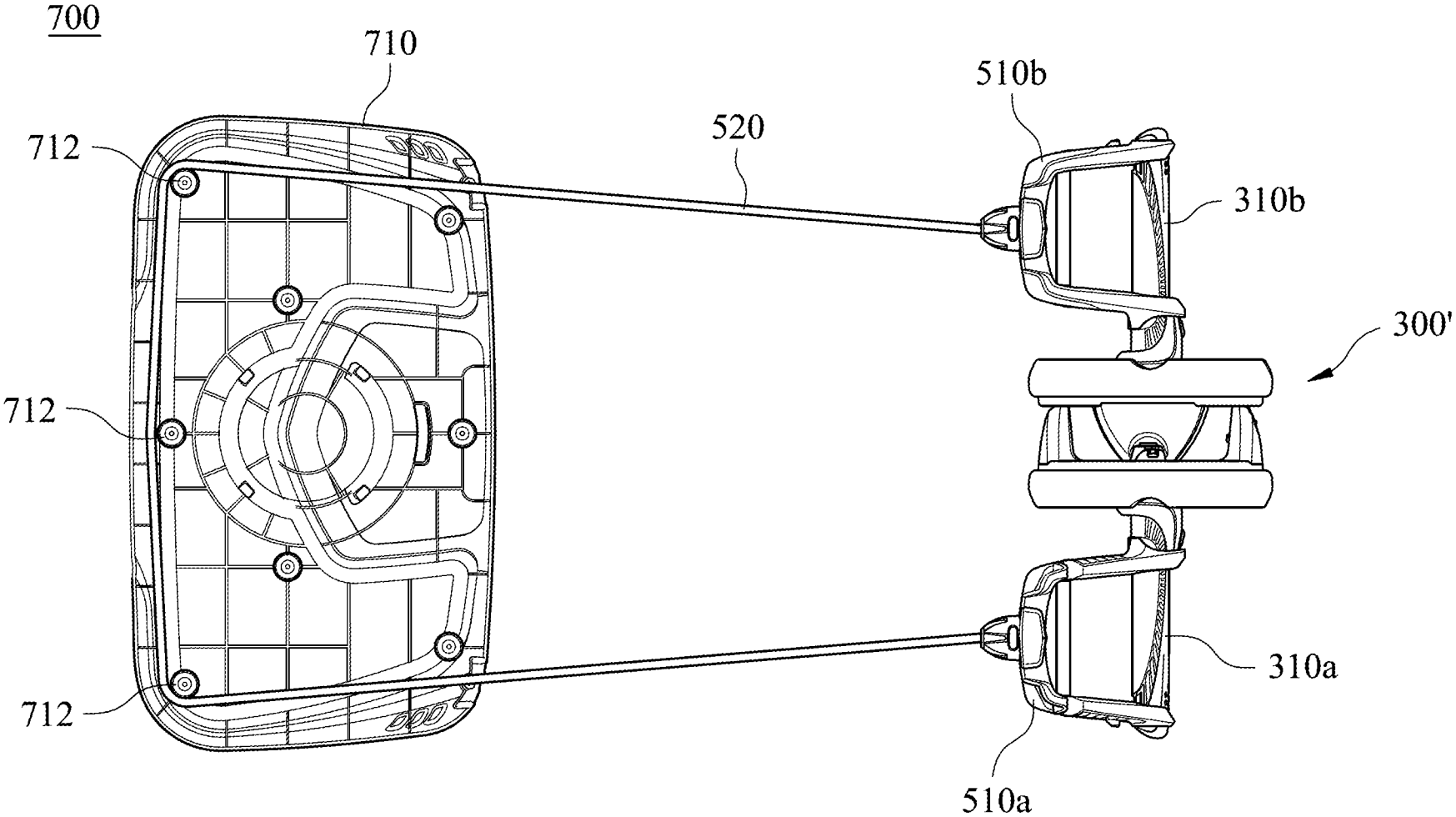
FIG. 7C is a bottom view of the exercising device set of FIG. 7A.

See FIG. 7A, FIG. 7B, and FIG. 7C, wherein FIG. 7A is a top view of an exercising device set 700 of one embodiment of the present disclosure, FIG. 7B is a side view of the exercising device set 700 of FIG. 7A, and FIG. 7C is a bottom view of the exercising device set 700 of FIG. 7A. In the present embodiment, the exercising device set 700 includes the exercising device 300', the first handle case 510*a*, the second handle case 510*b*, the elastic rope 520, and a kneeling pad 710. The way that the handle 310*a* and the handle 310*b* of the exercising device 300' assembled with the first handle case 510*a* and the second handle case 510*b* may be referred to the related descriptions of FIG. 5A and FIG. 5B, which will not be repeated herein.

A plurality of pillars 712 is disposed at a bottom surface of the kneeling pad 710, and the elastic rope 520 may twine the pillars 712. In this way, when the user kneels on the kneeling pad 710, the user may hold the handle 310*a* and the handle 310*b* with both hands to perform the aforementioned rolling operation in a kneeling position. Meanwhile, the elastic force provided by the elastic rope 520 may assist the user to pull the exercising device 300' back, such that the risk of getting injured during the rolling operation may be reduced.

Figure 8A:
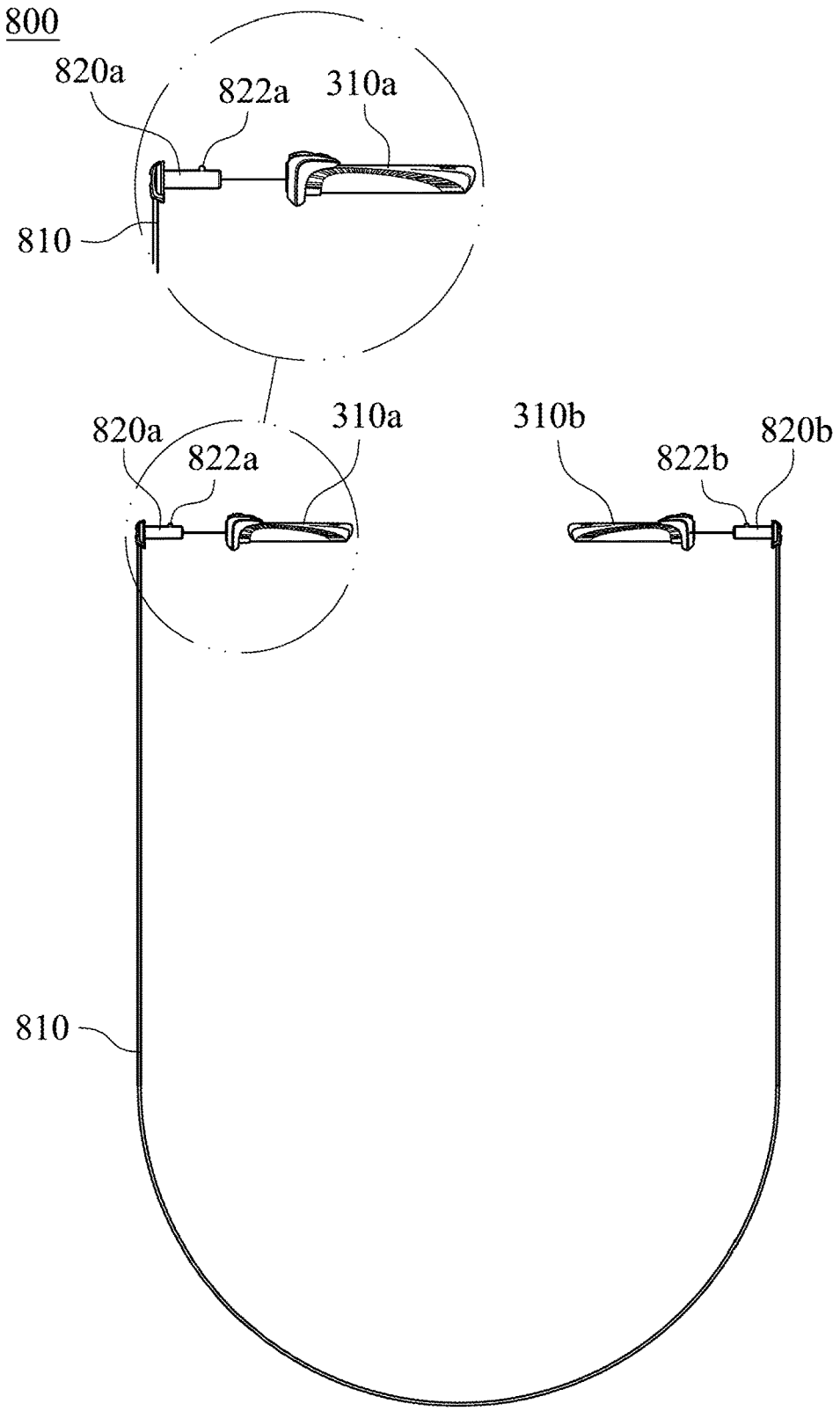
FIG. 8A is a schematic view of assembling an exercising device set.
Figure 8B:
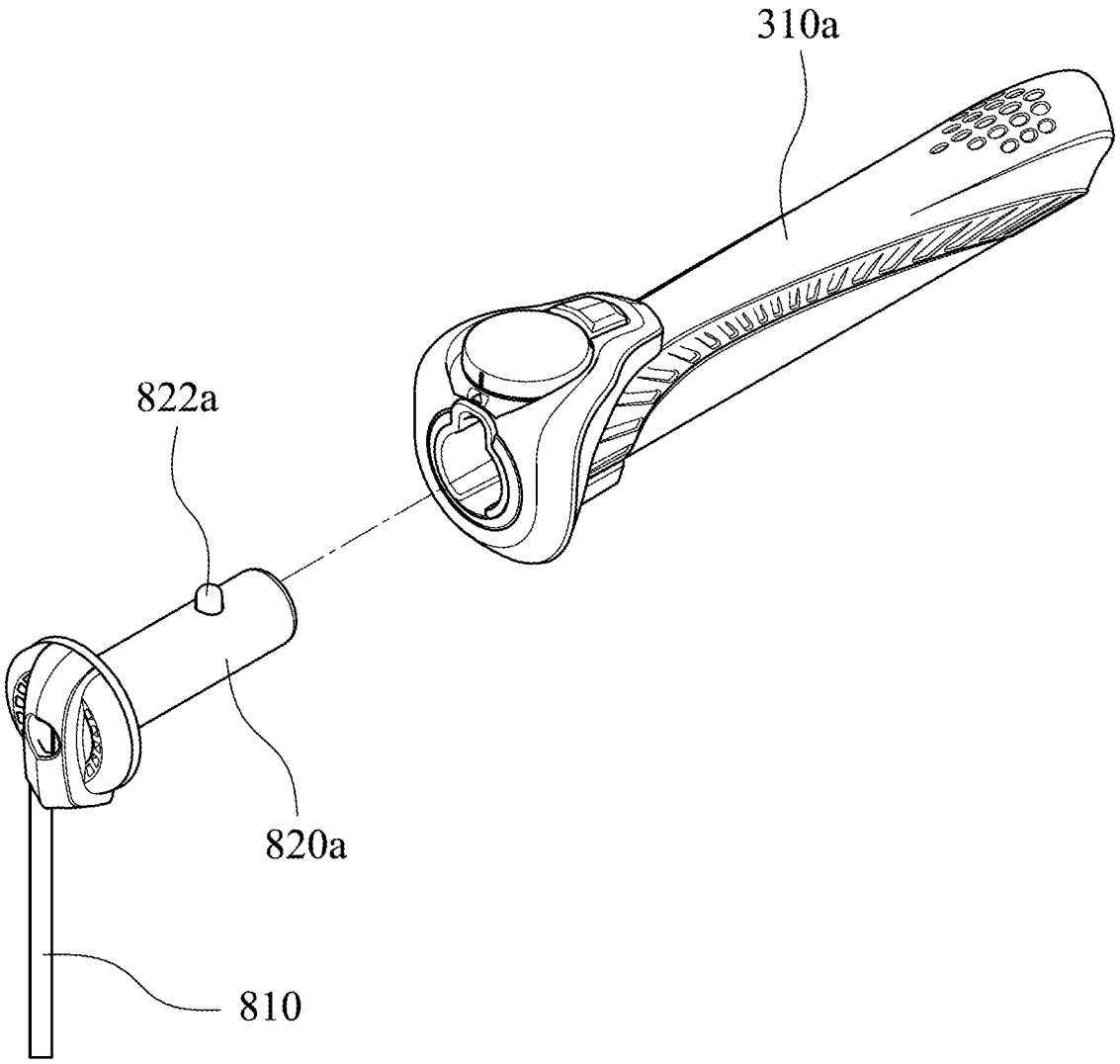
FIG. 8B is a schematic view of assembling the handle with an inserting portion of FIG. 8A.
Figure 8C:
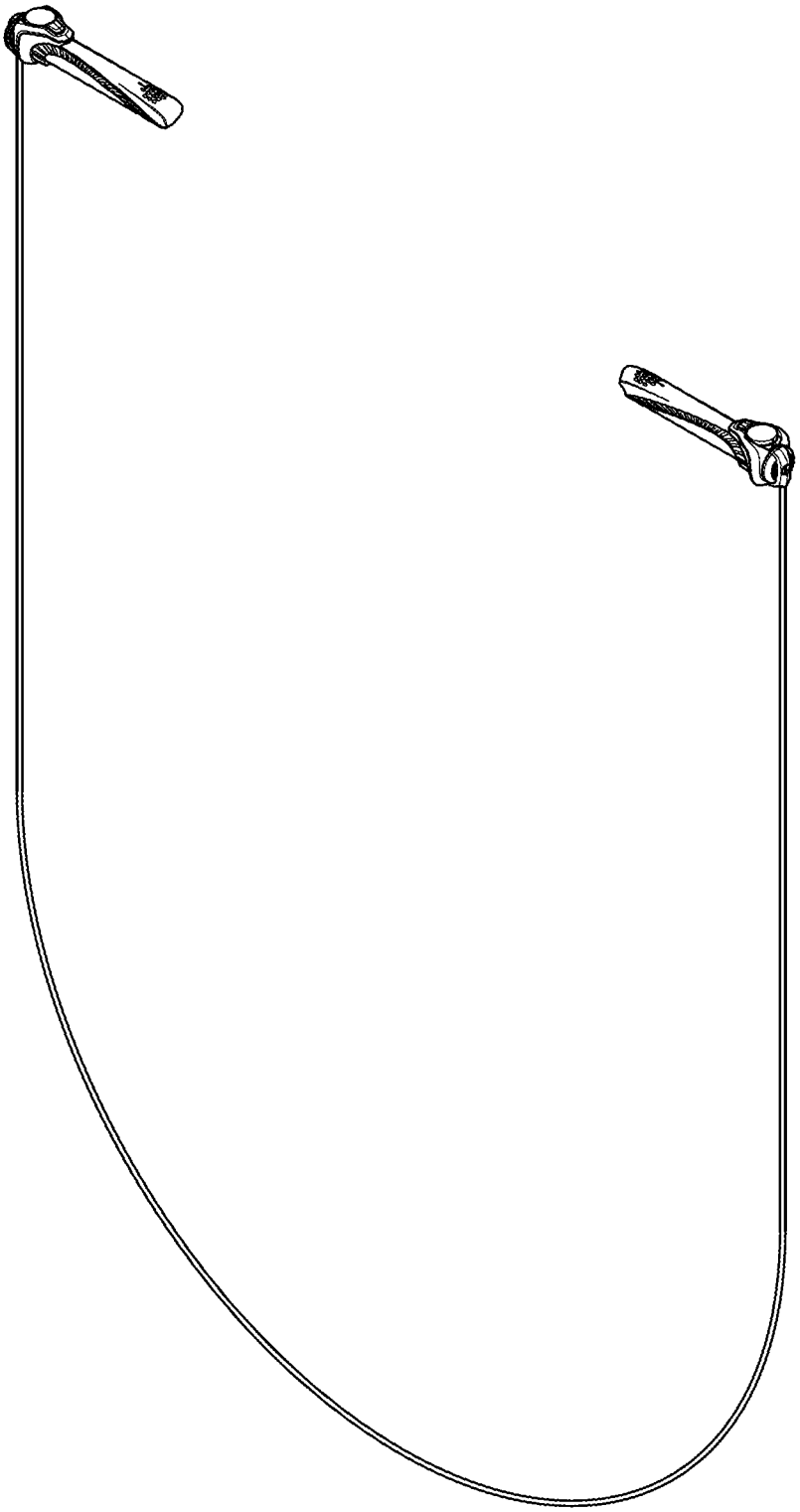
FIG. 8C is a schematic view of the assembled exercising device set.

See FIG. 8A, FIG. 8B, and FIG. 8C, wherein FIG. 8A is a schematic view of assembling an exercising device set 800, FIG. 8B is a schematic view of assembling the handle 310*a* with an inserting portion 820*a* of FIG. 8A, and FIG. 8C is a schematic view of the assembled exercising device set 800. In the present embodiment, the exercising device set 800 includes a rope 810, the handle 310*a*, and the handle 310*b*. Two ends of the rope 810 are disposed with the inserting portion 820*a* and an inserting portion 820*b*, wherein the inserting portion 820*a* and the inserting portion 820*b* are respectively disposed with reeds 822*a* and 822*b*. In one embodiment, the reeds 822*a* and 822*b* may be the same as the reeds 322*a* and 322*b* shown in FIG. 3A and FIG. 3B, but the present disclosure is not limited thereto.

As shown in FIG. 8A and FIG. 8B, the inserting portion 820*a* and the inserting portion 820*b* of the rope 810 may respectively insert the chambers of the handle 310*a* and the handle 310*b*. The reeds 822*a* and 822*b* may be respectively buckled by the buckle portions of the handle 310*a* and the handle 310*b*. In this way, the rope 810, the handle 310*a*, and the handle 310*b* may be combined as the exercising device set 800 for a jumping rope operation.

In one embodiment, when the user wants to remove the inserting portion 820*a* and the inserting portion 820*b* of the rope 810 from the handle 310*a* and the handle 310*b*, the user may press the release buttons (not labelled) on the handle 310*a* and the handle 310*b* to release the reeds 822*a* and 822*b* buckled by the buckle portions (not labelled) of the handle 310*a* and the handle 310*b*.

In one embodiment, the handle 310*a* or the handle 310*b* may be disposed with a sensor for detecting the number of the rope 810 rotates, such that the number of the user performing the jumping rope operation can be monitored. The sensor may be a g-sensor, but the present disclosure is not limited thereto.

Figure 9:
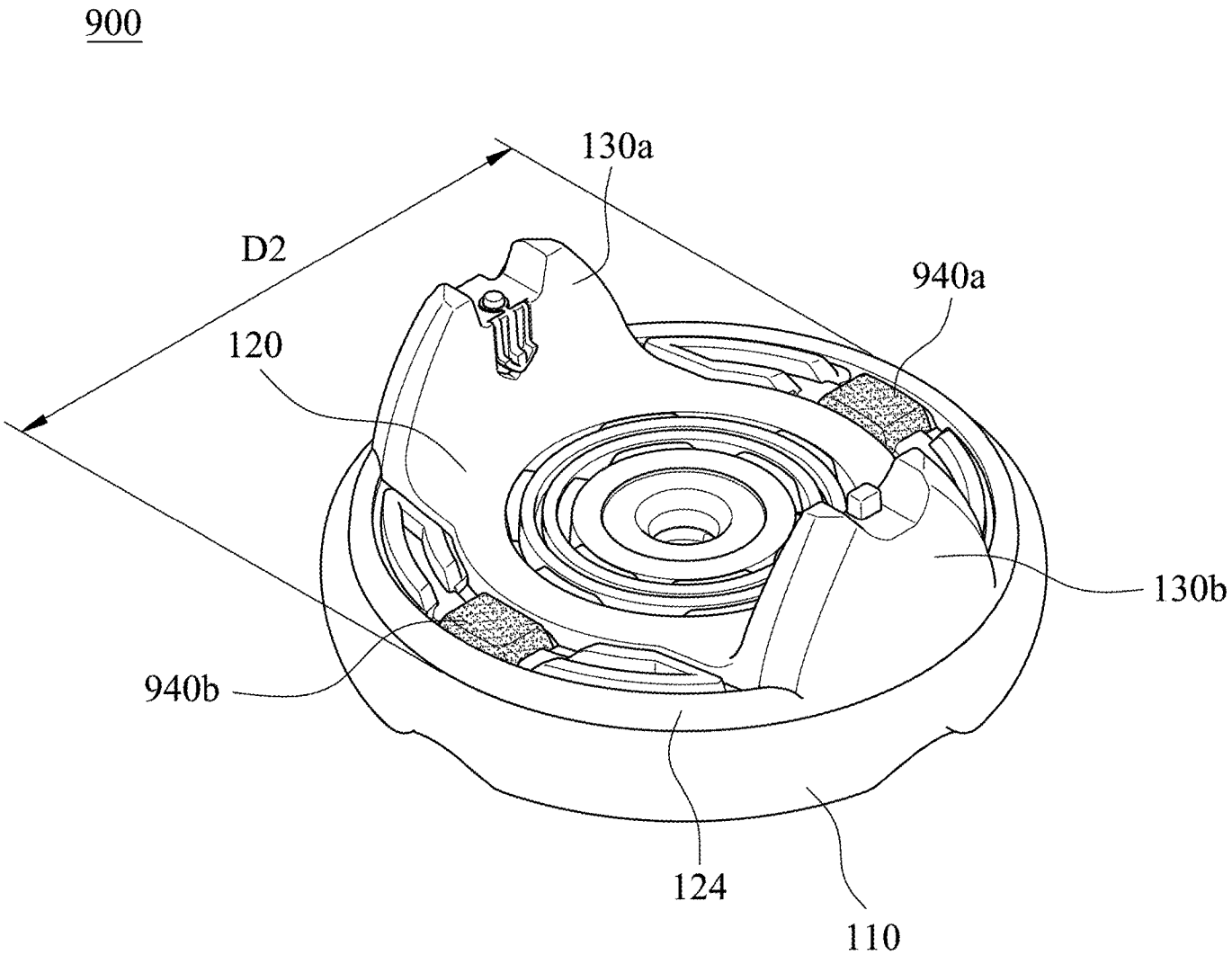
FIG. 9 is a schematic view of a roller exercising device of one embodiment of the present disclosure.

See FIG. 9, which is a schematic view of a roller exercising device 900 of one embodiment of the present disclosure. In the present embodiment, the roller exercising device 900 includes the base 110, the rotary plate 120, the support 130*a*, the support 130*b*, an abutting portion 940*a*, and an abutting portion 940*b*. In the roller exercising device 900, the structures and features of the base 110, the rotary plate 120, the support 130*a*, and the support 130*b* can be referred to the descriptions of FIG. 1A to FIG. 1C, which will not be repeated herein. Noted that the roller exercising device 900 includes the abutting portion 940*a* and the abutting portion 940*b* which are disposed at the top surface 124 of the rotary plate 120 and respectively locates at two ends of the second diameter D2.

In the present embodiment, the abutting portion 940*a* and the abutting portion 940*b* may be soft pads to be easily assembled with another roller exercising device identical to the roller exercising device 900. Specifically, when the roller exercising device 900 is combined with the other roller exercising device in a face-to-face way, the support 130*a* and the support 130*b* of the roller exercising device 900 may abut the abutting portions of the other roller exercising device. Meanwhile, the supports of the other roller exercising device may abut the abutting portion 940*a* and the abutting portion 940*b* of the roller exercising device 900, and hence an exercising device similar to the roller exercising device 300 shown in FIG. 3A can be formed to be used with the handle 310*a*, the handle 310*b*, and the connecting rod 320 for the user to perform the aforementioned movements, which will not be repeated herein.

Under the situation of disposing the soft pads, the collision between the roller exercising device 900 and the other roller exercising device may be reduced while facilitating the assembling and disassembling process.

From another perspective, the female buckle 140*a* and the female buckle 140*b* of the first roller exercising device 100 shown in FIG. 1B may be regarded as other implementations of the abutting portion 940*a* and the abutting portion 940*b*, but the present disclosure is not limited thereto.

Figure 10A:
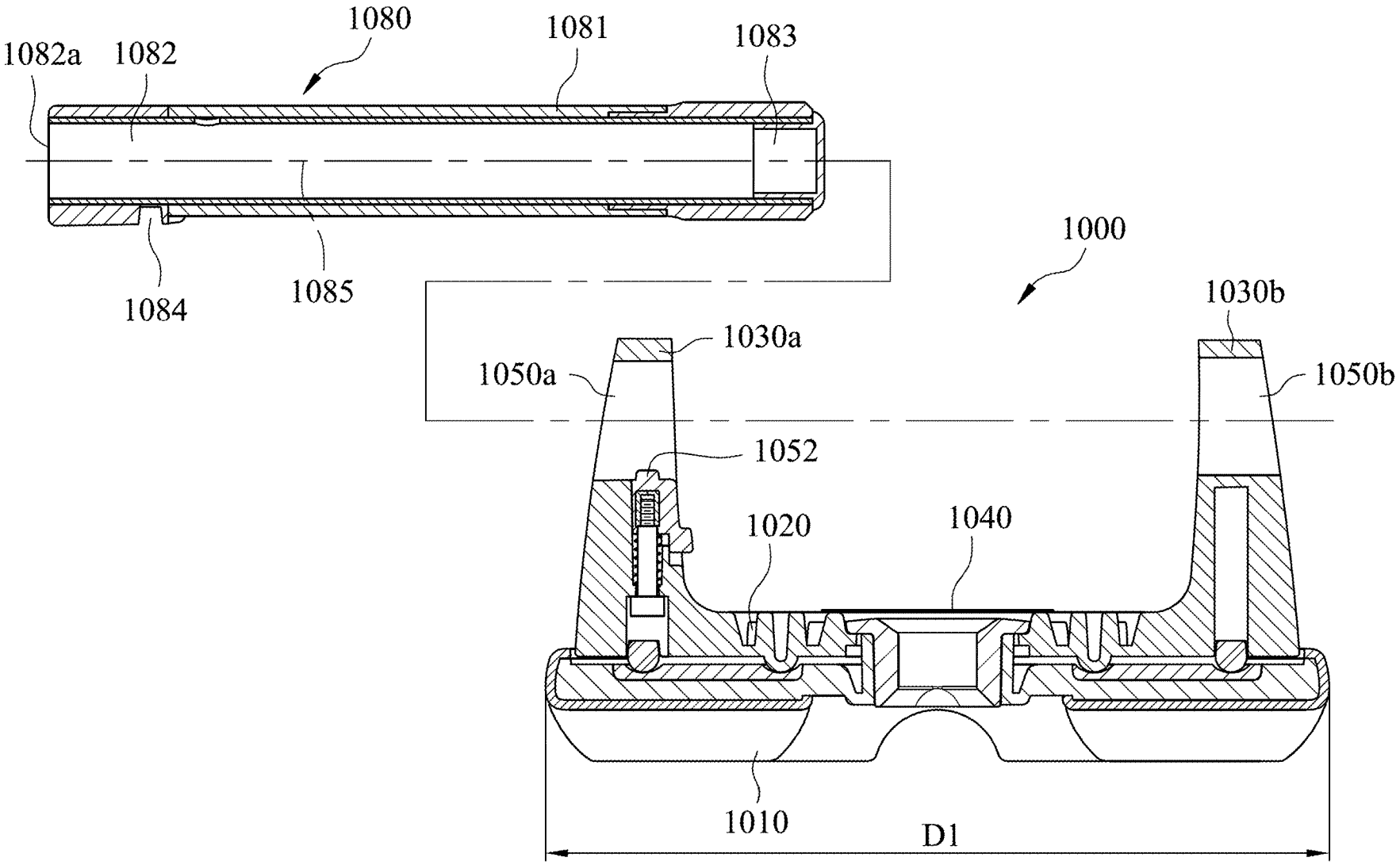
FIG. 10A is a side cross-sectional view of assembling a handle exercising device with a roller exercising device according to one embodiment of the present disclosure.
Figure 10B:
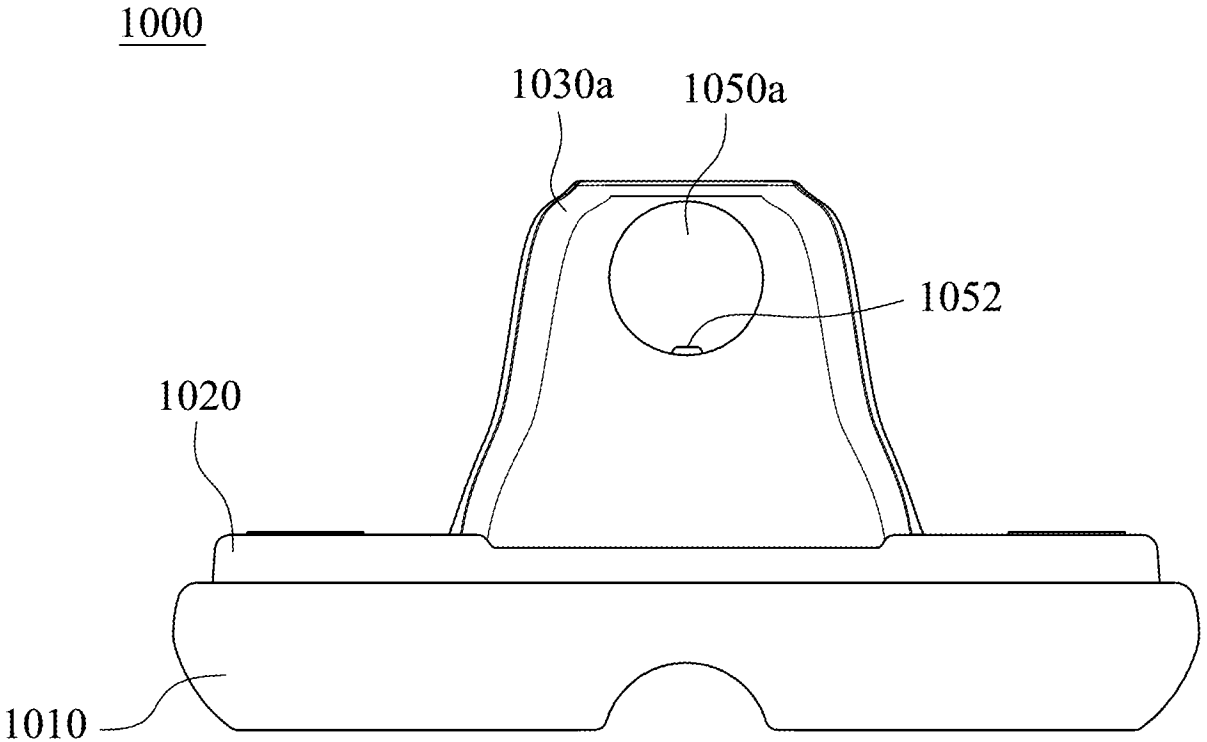
FIG. 10B is a side view of the roller exercising device.
Figure 10C:
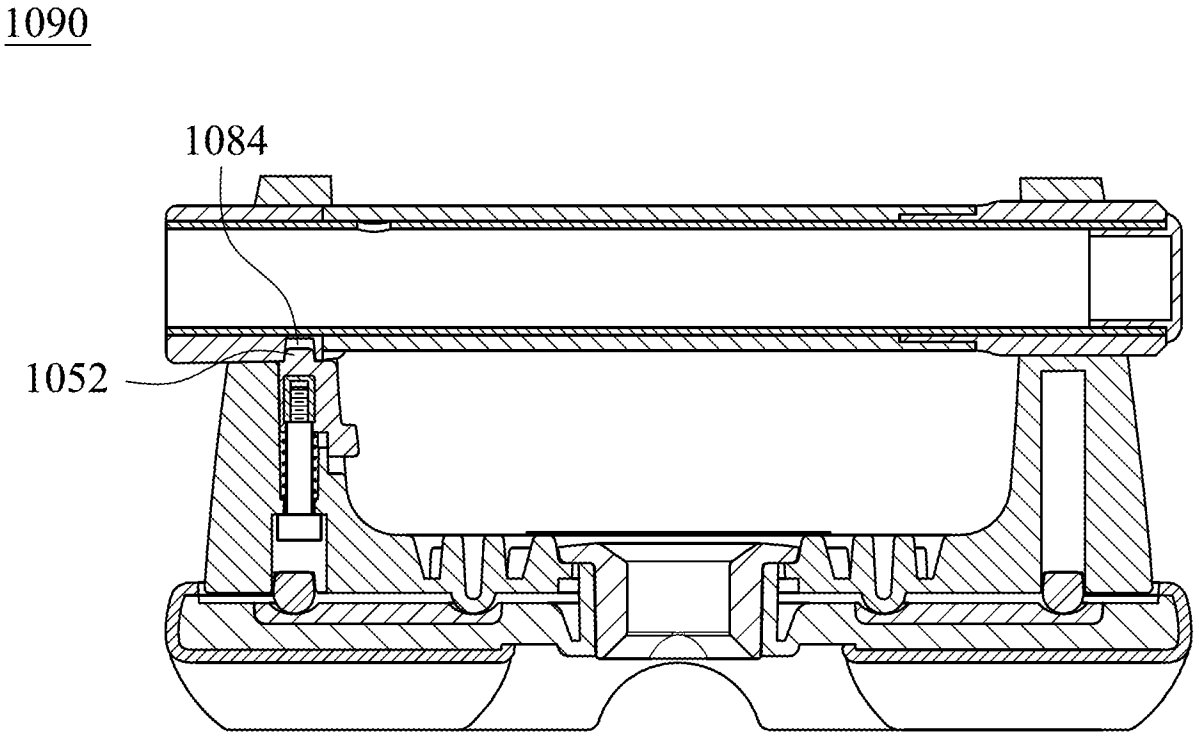
FIG. 10C is a side cross-sectional view of assembling the handle exercising device with the roller exercising device as an exercising device according to FIG. 10A.

See FIG. 10A, FIG. 10B, and FIG. 100, wherein FIG. 10A is a side cross-sectional view of assembling a handle exercising device 1080 with a roller exercising device 1000 according to one embodiment of the present disclosure, FIG. 10B is a side view of the roller exercising device 1000, and FIG. 10C is a side cross-sectional view of assembling the handle exercising device 1080 with the roller exercising device 1000 as an exercising device 1090 according to FIG. 10A. In the present embodiment, the roller exercising device 1000 includes a base 1010, a rotary plate 1020, a support 1030*a*, a support 1030*b*, and an abutting portion 1040. In the roller exercising device 1000, the structures and features of the base 1010, the rotary plate 1020, and the abutting portion 1040 may be referred to the teachings described in the previous embodiments, which will not be repeated herein.

Noted that the support 1030*a* and the support 1030*b* are respectively disposed with a through hole 1050*a* and a through hole 1050*b*, wherein axial directions of the through hole 1050*a* and the through hole 1050*b* are parallel to the first diameter D1, and the through hole 1050*a* and the through hole 1050*b* are aligned with each other. Moreover, a male buckle 1052 of the present embodiment may be disposed at a lower edge of the through hole 1050*a*.

In addition, the handle exercising device 1080 includes a handle body 1081, an accommodating space 1082, an engaging portion 1083, and a female buckle 1084. The handle body 1081 may be covered by a polyurethane or poly foam for facilitating the user to hold. The accommodating space 1082 may be disposed in the handle body 1081 along an axial direction 1085 of the handle body 1081, wherein the accommodating space 1082 has an opening 1082*a* facing one end of the handle body 1081. In the present embodiment, the accommodating space 1082 is a chamber, but the accommodating space 1082 may be a through hole in other embodiments as well. The female buckle 1084 is disposed at the bottom surface of the handle body 1081 and closer to one end of the handle body 1081. In the present embodiment, the female buckle 1084 may be disposed at the end opposite to where the opening 1082*a* locates, but the female buckle 1084 and the opening 1082*a* may be disposed at the same end in other embodiments as well. The engaging portion 1083 is disposed in the accommodating space 1082 to engage the predetermined assembly inserting the accommodating space 1082 via the opening 1082*a*.

The circumference of the handle exercising device 1080 may correspond to the sizes of the through hole 1050*a* and the through hole 1050*b*, and the length of the handle exercising device 1080 may be larger than the distance between the through hole 1050*a* and the through hole 1050*b*. In this case, the handle exercising device 1080 may penetrate the through hole 1050*a* and the through hole 1050*b* as shown in FIG. 10A, and when the male buckle 1052 is aligned with the female buckle 1084, the male buckle 1052 may buckle the female buckle 1084 to form the exercising device 1090 shown in FIG. 10C.

As a result, the user may use the exercising device 1090 to perform movements such as push-ups, but the present disclosure is not limited thereto.

Figure 11:
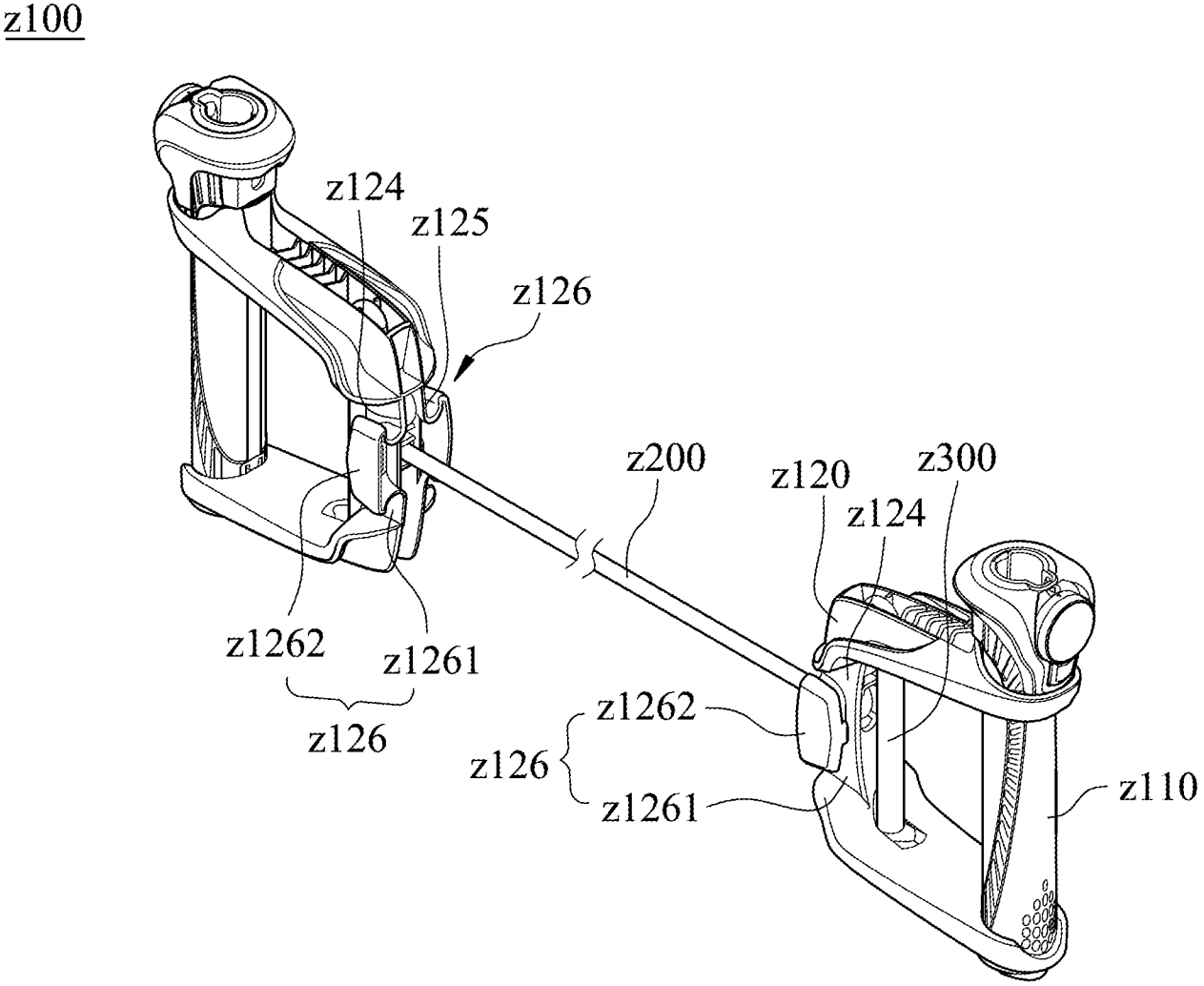
FIG. 11 is a 3-D view of one embodiment of the present disclosure.
Figure 12A:
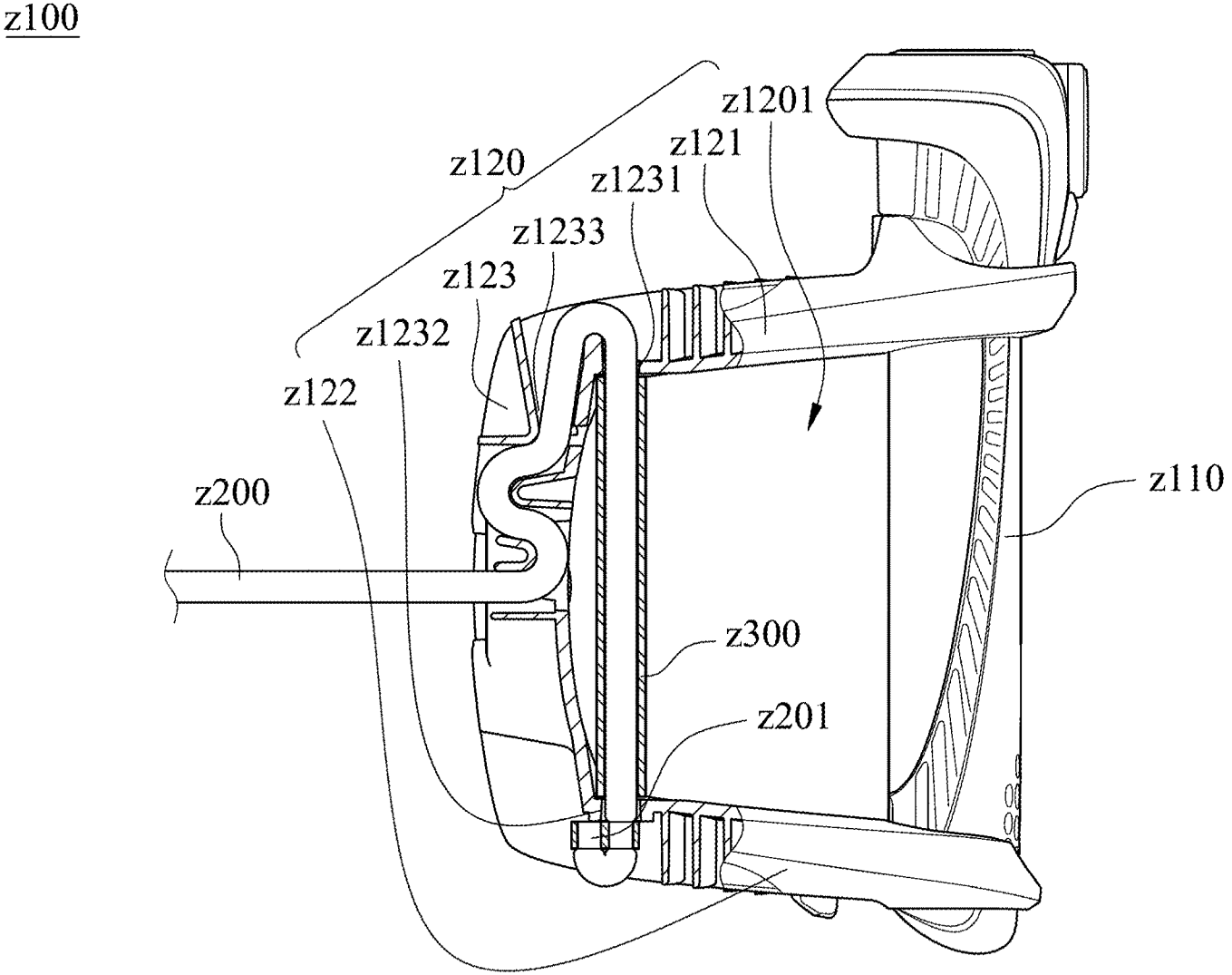
FIG. 12A is a partial cross-sectional view of FIG. 11.
Figure 12B:
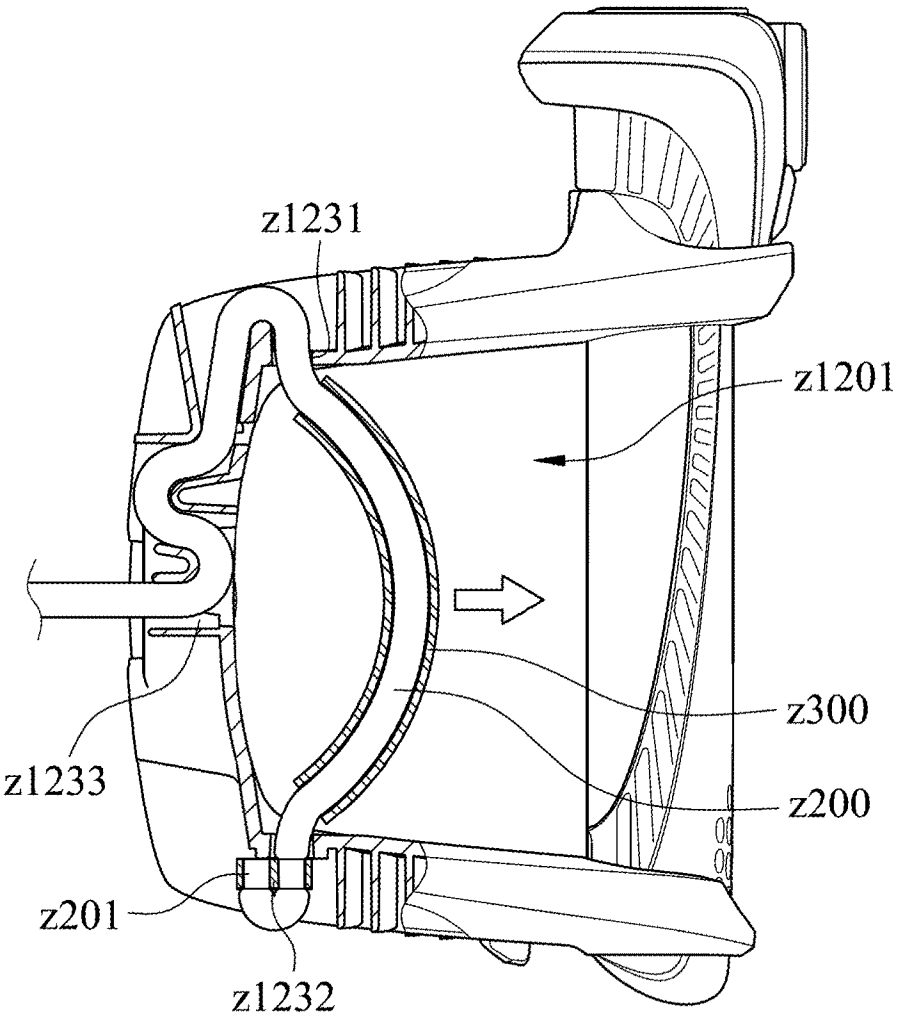
FIG. 12B is a schematic view of doing exercise with a pulling rope of FIG. 12A.

See FIG. 11, FIG. 12A, and FIG. 12B, wherein FIG. 11 is a 3-D view of one embodiment of the present disclosure, FIG. 12A is a partial cross-sectional view of FIG. 11, and FIG. 12B is a schematic view of doing exercise with a pulling rope z100 of FIG. 12A. The pulling rope z100 of the present embodiment includes two handles z110, two handguards z120, an elastic rope z200, and two tubular cases z300, which will be described in detail.

The handle z110 may be the same as the handle exercising device 200 of FIG. 2A to be held by a palm. In other embodiments, the handle z110 may be other cylindrical rods that are detachable, but the present disclosure is not limited thereto.

The handguard z120 may be a variation of the first handle case 510*a* and the second handle case 510*b* shown in FIG. 5A to FIG. 7C, and hence the handguard z120 may be used to replace the first handle case 510*a* and the second handle case 510*b* mentioned in previous embodiments, but the present disclosure is not limited thereto.

In the present embodiment, the handguard z120 may be U-shaped and have two ends z121, z122, and an extending segment z123, wherein the two ends z121 and z122 are connected with two ends of the handle z110 to form a holding space z1201 between the extending segment z123 and the handle z110. The holding space z1201 is roughly an open rectangle. The extending segment z123 has two limiting holes z1231 facing the holding space z1201 and corresponding to each other. Two surfaces z124 and z125 are disposed on the extending segment z123 and face different directions, and the extending segment z123 further include two twining portions z126 respectively disposed at the two surfaces z124 and z125 facing different directions. The twining portion z126 includes a recess z1261 and a T-shaped protruding rod z1262 disposed in the recess z1261, and the elastic rope z200 may twine via the recess z1261 and the T-shaped protruding rod z1262. The extending segment z123 may further have a tortuous channel z1233 disposed therein, and the tortuous channel z1233 may be disposed between the two surfaces z124 and z125. One end of the tortuous channel z1233 is connected with the limiting hole z1231, and another end of the tortuous channel z1233 outwardly opens at a center of the extending segment z123. The elastic rope z200 is limited by the tortuous channel z1233 and reaches out via the center of the extending segment z123.

One end z201 of the elastic rope z200 is fixed on the handguard z120 to be stretched, and the elastic rope z200 is limited by the limiting holes z1231 and z1232 and goes through the holding space z1201. Another end of the elastic rope z200 is connected with another handguard z120. The designs and structures of another set of handle z110, handguard z120, and tubular case z300 are the same as the above teachings, which will not be further discussed.

The tubular case z300 is a hollowed tube made of a soft material, and the tubular case z300 is disposed between the limiting holes z1231 and z1232. The tubular case z300 is sleeved on the elastic rope z200, and hence the tubular case z300 locates in the holding space z1201 between the extending segment z123 and the handle z110. The fingers of the user may pull the elastic rope z200 via pulling the tubular case z300.

Figure 13:
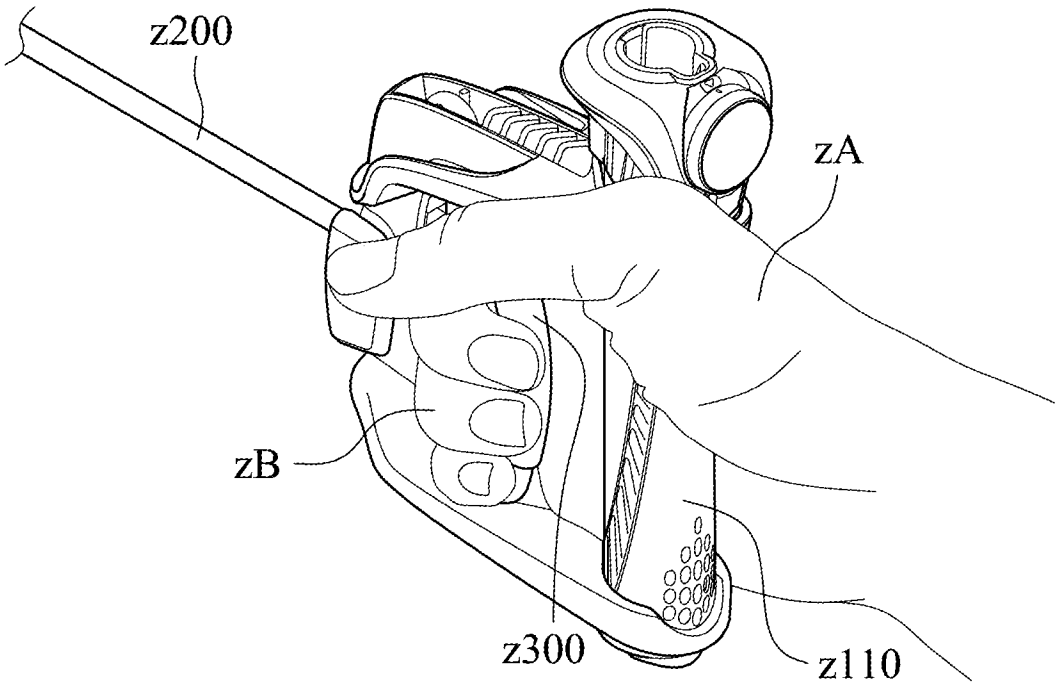
FIG. 13 is a schematic view of using the pulling rope.
Figure 14:
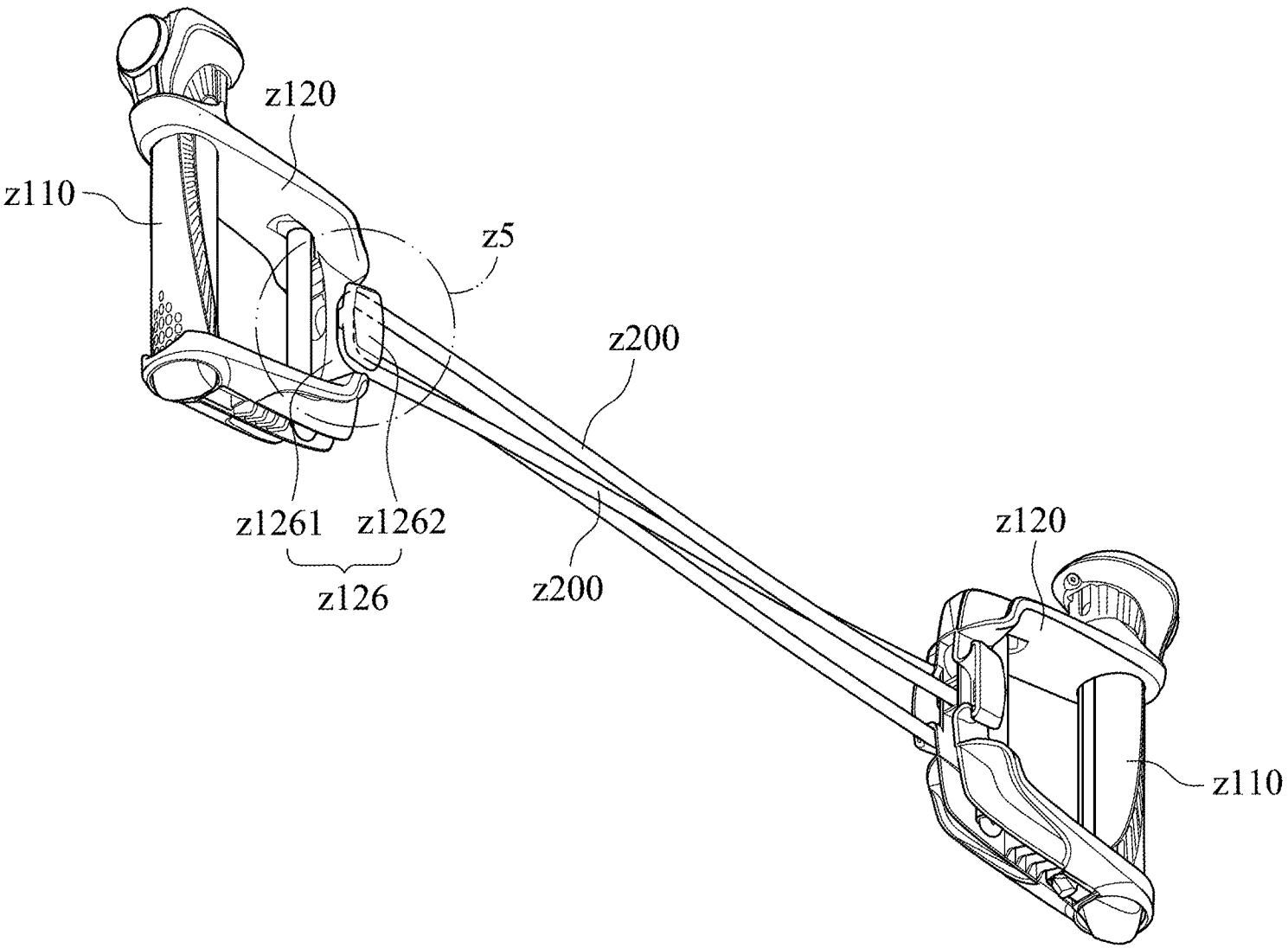
FIG. 14 is a schematic view of repeatedly folding the elastic rope of the pulling rope.
Figure 15:
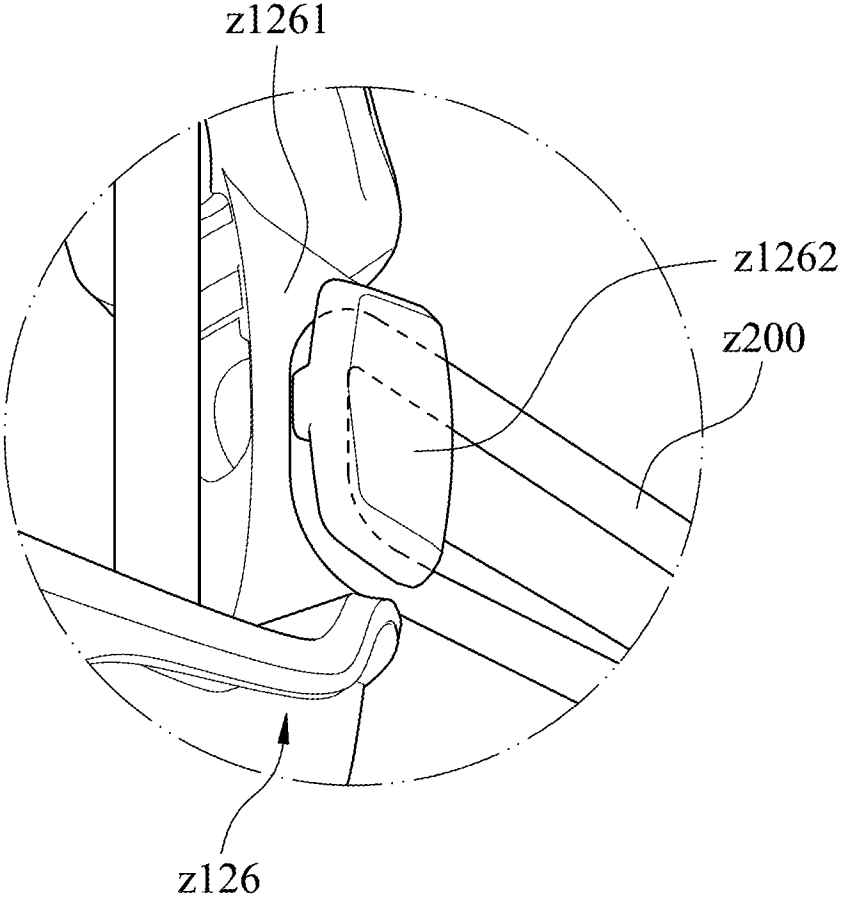
FIG. 15 is an enlarged transparent view of an area of FIG. 14.

See FIG. 13, FIG. 14, and FIG. 15, wherein FIG. 13 is a schematic view of using the pulling rope z100, FIG. 14 is a schematic view of repeatedly folding the elastic rope z200 of the pulling rope z100, and FIG. 15 is an enlarged transparent view of an area z5 of FIG. 14. Details will be discussed in the following paragraphs.

A palm zA of the user may stably hold the handle z110. Meanwhile, four fingers zB of the user may directly pull the tubular case z300. Since the tubular case z300 is sleeved on the elastic rope z200, the tubular case z300 may provide sufficient recovering elastic force. Accordingly, the tubular case z300 of the present disclosure is convenient for the user to directly pull with the fingers, and hence the training effects of grip can be achieved.

Similarly, the user may use two handles z110 and two handguards z120 of the present disclosure to reciprocatingly perform push and pull movements. In other embodiments, if one end of the elastic rope z200 is fixed on a wall or a pad (such as the kneeling pad 710 shown in FIG. 7A), the user may merely use one handle z110 and one handguard z120 to perform workout movements to achieve training effects.

Figure 16:
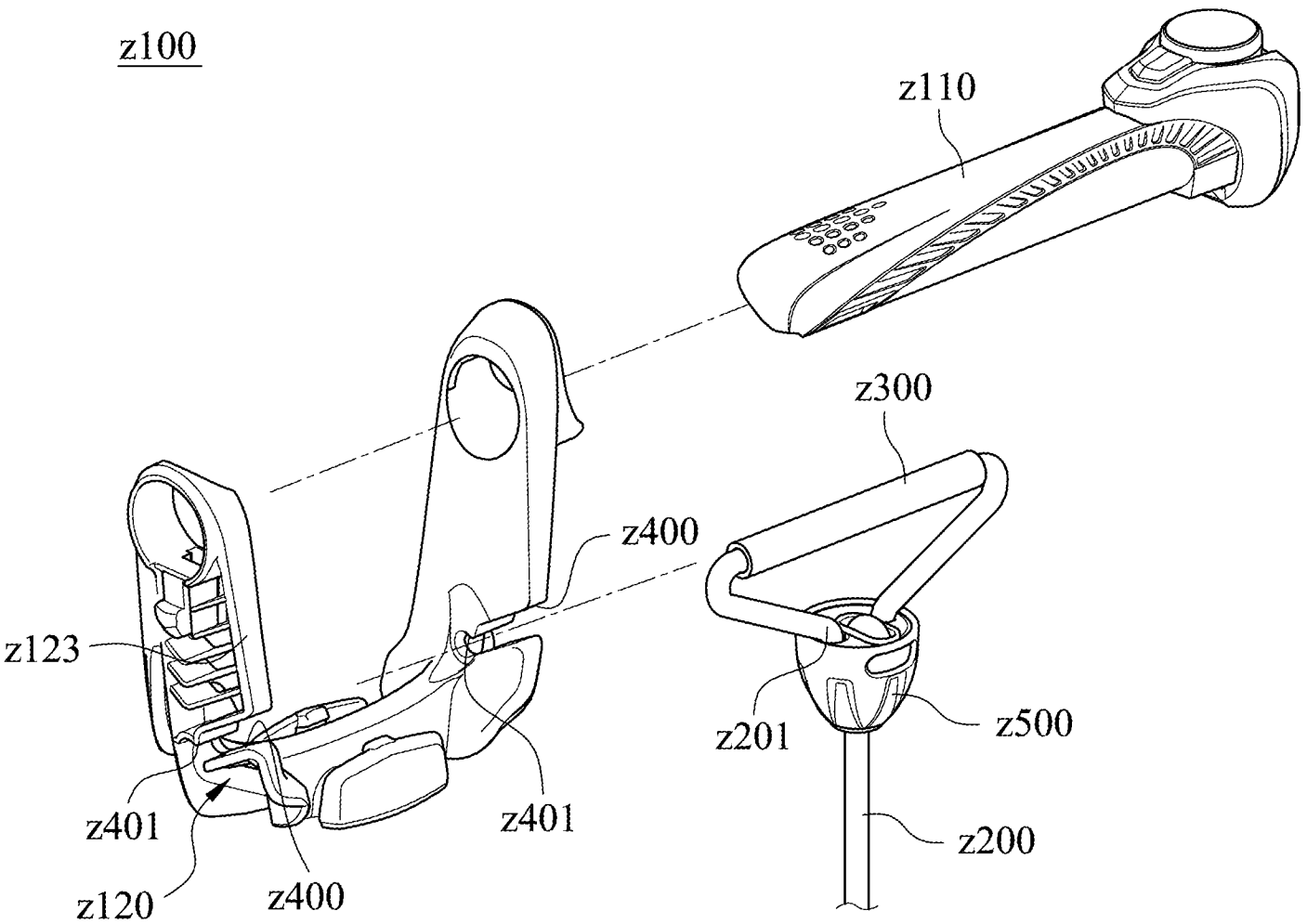
FIG. 16 is an exploded view.
Figure 17:
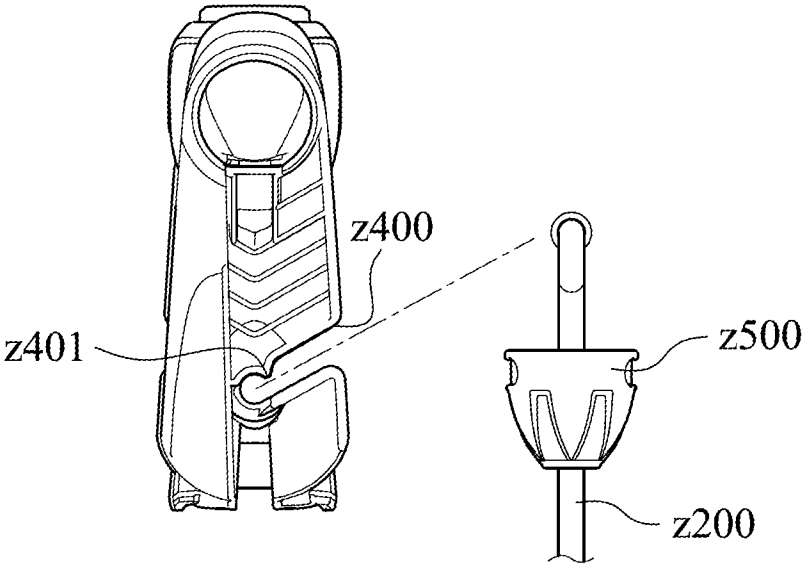
FIG. 17 is a side view of the pulling rope of FIG. 16.
Figure 18:
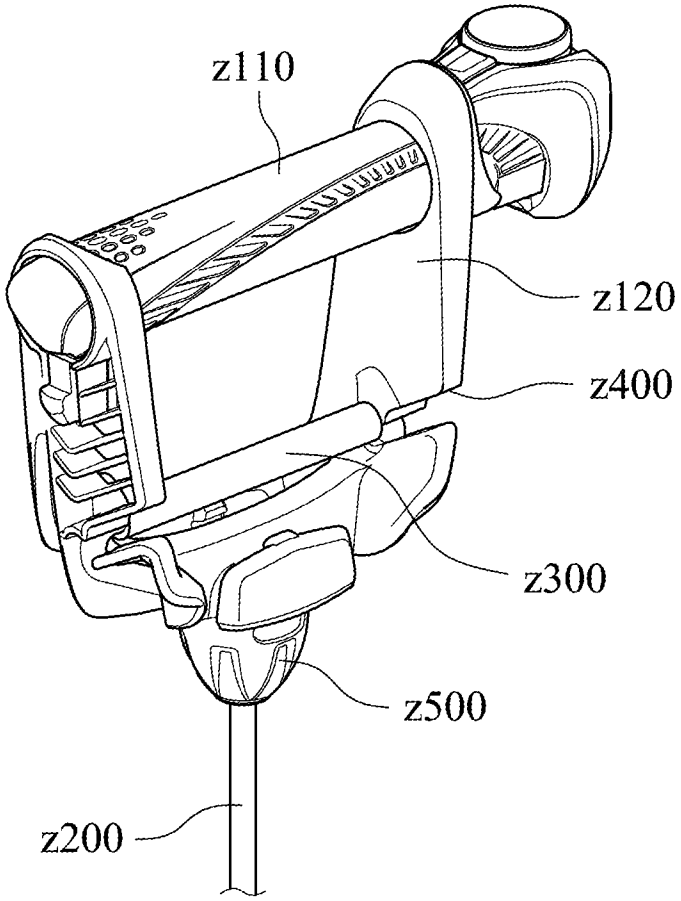
FIG. 18 is a 3-D view of the pulling rope of FIG. 16.

See FIG. 16, FIG. 17, and FIG. 18, wherein FIG. 16 is an exploded view, FIG. 17 is a side view of the pulling rope z100 of FIG. 16, and FIG. 18 is a 3-D view of the pulling rope z100 of FIG. 16. In the present embodiment, the pulling rope z100 includes the handle z110 the handguard z120, the elastic rope z200, and the tubular case z300. Details of the parts identical to the previous embodiments will not be repeated herein, and the improved parts of the present embodiment will be discussed hereinafter.

The extending segment z123 is disposed with two opened limiting slots z400 which are tiltably formed on the same side of the handguard z120. Each of the opened limiting slots z400 is disposed with a protruding portion z401, and the protruding portion z401 is used with the opened limiting slots z400 to stably limit the elastic rope z200. The pulling rope z100 further includes a hollowed connecting head z500 penetrated by the elastic rope z200, and the one end z201 of the elastic rope z200 is limited on the hollowed connecting head z500 after twining the opened limiting slots z400.

Accordingly, the user may use the protruding portion z401 with the opened limiting slots z400 to efficiently and stably limit the elastic rope z200 or remove the elastic rope z200. The concept of disposing the hollowed connecting head z500 may simplify the structural complexity of the handguard z120.

Based on the above, the pulling rope of FIG. 11 to FIG. 18 at least has the following advantages: (1) applicable for the user to train the user's grip strength; (2) allowing the user to perform a chest fly or a shoulder press while training the user's grip strength; (3) the twining portion thereof can be stably and adjustably twined by the elastic rope based on the loading requirements; and (4) the number of the elastic rope being folded can be adjusted based on the loading requirements.

To sum up, the roller exercising device proposed in the present disclosure may be combined with different devices, such as the handle exercising device, pulling rope, and kneeling pad. etc., to form various exercising device sets. Moreover, since the user may vary the ways of exercising by assembling the exercising devices with little effort, the roller exercising device may improve the will of the user to do exercises by providing less limitation, more variability, and more fun, such that the training effects can be achieved.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A roller exercising device set, comprising:

two roller exercising devices used with a predetermined assembly, wherein each of the roller exercising devices comprises:

a base having a first central through hole;

a rotary plate rotatably connected with the base and having a second central through hole, a first diameter, and a second diameter, wherein the second central through hole corresponds to the first central through hole;

two supports respectively disposed at two ends of the first diameter and extending toward a normal direction of a top surface of the rotary plate, wherein at least one of the two supports is disposed with a male buckle; and two abutting portions disposed on the top surface of the rotary plate and respectively locating at two ends of the second diameter;

wherein when the two roller exercising devices are used, one of the roller exercising devices is combined with another one of the roller exercising devices in a face-to-face way to form an exercising device, the two supports of the one of the roller exercising devices abut the abutting portions of the another one of the roller exercising devices, and the two supports of the another one of the roller exercising devices abut the abutting portions of the one of the roller exercising devices.

2. The roller exercising device set of claim 1, wherein in each of the roller exercising devices, the two abutting portions are disposed with two female buckles denting the top surface of the rotary plate, each of the two supports is disposed with the male buckle, the female buckles correspond to the male buckle on each of the two supports, and each of the roller exercising devices is detachably connected with the predetermined assembly via the female buckles and the male buckle on each of the two supports.

3. The roller exercising device set of claim 1, wherein in each of the roller exercising devices, the male buckle is disposed at a top of one of the two supports.

4. The roller exercising device set of claim 1, wherein in each of the roller exercising devices, the two supports are disposed with two through holes whose axial directions are parallel to the first diameter, the two through holes are aligned with each other, and the male buckle is disposed at a lower edge of one of the through holes.

* * * * *